US007883450B2

(12) United States Patent
Hidler

(10) Patent No.: US 7,883,450 B2
(45) Date of Patent: Feb. 8, 2011

(54) BODY WEIGHT SUPPORT SYSTEM AND METHOD OF USING THE SAME

(76) Inventor: Joseph Hidler, 5563 Seminary Rd., Apt. 112, Falls Church, VA (US) 22041

( * ) Notice: Subject to any disclaimer, the term of this patent is extended or adjusted under 35 U.S.C. 154(b) by 80 days.

(21) Appl. No.: 12/120,420

(22) Filed: May 14, 2008

(65) Prior Publication Data

US 2008/0287268 A1 Nov. 20, 2008

Related U.S. Application Data

(60) Provisional application No. 60/917,830, filed on May 14, 2007.

(51) Int. Cl.
*A61H 3/00* (2006.01)

(52) U.S. Cl. ..... 482/69; 212/74; 212/86; 212/104; 212/119; 212/284; 212/328; 212/346; 601/23

(58) Field of Classification Search ..... 212/71, 212/74, 86, 101, 104, 119, 284, 285, 328, 212/346; 254/270, 331, 360; 482/69, 94; 601/23

See application file for complete search history.

(56) References Cited

U.S. PATENT DOCUMENTS 2,871,915 A 2/1959 Hogan
3,204,954 A 9/1965 Scannell
3,780,663 A * 12/1973 Pettit ..... 104/307
3,985,082 A * 10/1976 Barac ..... 104/89
4,164,350 A 8/1979 Zeijdel et al.
4,229,136 A 10/1980 Panissidi
4,243,147 A * 1/1981 Twitchell et al. ..... 212/284
4,252,063 A * 2/1981 Brooks, Jr. ..... 104/89
4,445,502 A * 5/1984 Swan et al. ..... 601/23
4,907,571 A 3/1990 Futakami
4,911,426 A * 3/1990 Scales ..... 482/69
4,973,044 A * 11/1990 Jones ..... 482/51
5,064,191 A 11/1991 Johnson
5,158,516 A 10/1992 Johnson
5,190,507 A * 3/1993 Iijima ..... 482/69
5,273,502 A 12/1993 Kelsey et al.
5,333,333 A 8/1994 Mah
5,337,908 A * 8/1994 Beck, Jr. ..... 212/312
5,372,561 A 12/1994 Lynch
5,569,129 A 10/1996 Seif-Naraghi et al.
5,695,432 A 12/1997 Soderlund
5,704,881 A * 1/1998 Dudley ..... 482/69
5,850,928 A * 12/1998 Kahlman et al. ..... 212/285

(Continued)

OTHER PUBLICATIONS

"A Novel Mechatronic Body Weight Support System" by Martin Frey, Gery Colombo, Martino Vaglio, Rainer Bucher, Matthias Jörg, and Robert Riener, IEEE Trans Neural Systems and Rehabilitation Engineering 2006, 36 pages.

*Primary Examiner*—Rinaldi I Rada
*Assistant Examiner*—Andrew M Tecco
(74) *Attorney, Agent, or Firm*—Edell, Shapiro & Finnan LLC

(57) ABSTRACT

A body-weight support system that allows individuals with severe gait impairments to practice over-ground walking in a safe, controlled manner is disclosed. The system includes a body-weight support system that rides along a driven trolley and can be controlled in response to the movement of the subject using the system.

3 Claims, 47 Drawing Sheets

U.S. PATENT DOCUMENTS 5,915,673 A 6/1999 Kazerooni
5,961,541 A 10/1999 Ferrati
5,980,435 A 11/1999 Joutras et al.
5,996,823 A 12/1999 Dyson
6,079,578 A 6/2000 Dyson
6,080,087 A * 6/2000 Bingham ..... 482/69
6,244,991 B1 * 6/2001 Bingham ..... 482/69
6,273,844 B1 8/2001 Kelsey et al.
6,302,828 B1 10/2001 Martin et al.
6,315,138 B1 * 11/2001 Dyson ..... 212/336
6,436,009 B1 * 8/2002 Marucci ..... 482/54
6,464,208 B1 * 10/2002 Smith ..... 254/324
6,645,126 B1 * 11/2003 Martin et al. ..... 482/54
6,666,831 B1 * 12/2003 Edgerton et al. ..... 600/587
6,890,288 B2 * 5/2005 Bingham ..... 482/69
6,907,630 B2 6/2005 Treon
6,942,630 B2 9/2005 Behan
6,997,668 B2 2/2006 Salesse et al.
7,125,388 B1 10/2006 Reinkensmeyer et al.
7,240,621 B2 * 7/2007 Chepurny et al. ..... 104/173.1
7,462,138 B2 * 12/2008 Shetty et al. ..... 482/69
2002/0065173 A1 5/2002 Cook
2004/0059589 A1 3/2004 Moore et al.
2004/0064436 A1 4/2004 Breslin et al.
2004/0097330 A1 5/2004 Edgerton et al.
2004/0172317 A1 9/2004 Davis et al.
2004/0199532 A1 10/2004 Meyers et al.
2005/0065754 A1 3/2005 Schaf et al.
2005/0065807 A1 3/2005 DeAngelis et al.
2005/0105772 A1 * 5/2005 Voronka et al. ..... 382/103
2005/0115914 A1 6/2005 Chepurny et al.
2005/0144062 A1 6/2005 Mittal et al.
2005/0165633 A1 7/2005 Huber
2005/0239613 A1 * 10/2005 Colombo et al. ..... 482/94
2006/0052728 A1 3/2006 Kerrigan et al.
2007/0004567 A1 * 1/2007 Shetty et al. ..... 482/69
2007/0016116 A1 1/2007 Reinkensmeyer et al.
2007/0215569 A1 9/2007 Chepurny et al.

* cited by examiner

BODY WEIGHT SUPPORT SYSTEM AND METHOD OF USING THE SAME

CROSS-REFERENCE TO RELATED APPLICATIONS

This application claims the benefit of U.S. Provisional Application No. 60/917,830, filed May 14, 2007, the disclosure of which is incorporated by reference herein in its entirety.

GOVERNMENT INTEREST

The U.S. Government has a paid-up license in this invention and the right in limited circumstances to require the patent owner to license others on reasonable terms as provided for by the terms of Contract No. H133E020724 awarded by the National Institute on Disability and Rehabilitation Research and Contract Nos. 05090003 and W81XWH-07-1-0624 awarded by the Telemedicine and Advanced Technology Research Center, United States Army Medical Research and Material Command.

BACKGROUND OF THE INVENTION

The present invention relates to a body-weight support system. In particular, the present invention relates to an improved body-weight support system.

Successfully delivering intensive yet safe gait therapy to individuals with significant walking deficits presents the greatest challenges to even the most skilled therapists. In the acute stages of many neurological injuries such as stroke, spinal cord injury, or traumatic brain injury, individuals often exhibit highly unstable walking patterns and poor endurance, making it difficult to safely practice gait for both the patient and therapist. Because of this, there has been a big push in rehabilitation centers to move over-ground gait training to the treadmill where body-weight support systems can help minimize falls while at the same time raising the intensity of the training.

Numerous studies have investigated the effectiveness of body-weight supported treadmill training and have found that this mode of gait training promotes gains in walking ability similar to or greater than conventional gait training. Unfortunately, there is a gap in technologies available on the market for transitioning subjects from training on a treadmill to safe, weight-supported over-ground gait training. Since a primary goal of all individuals with walking impairments is to walk in their homes and in the community rather than on a treadmill, it is imperative that therapeutic interventions targeting walking involve over-ground gait training.

Some conventional support systems involve training individuals with gait impairments over smooth, flat surfaces. However, these systems have their limitations. In some systems, therapists are significantly obstructed from interacting with the subject, particularly their lower legs. For patients that require partial assistance to stabilize their knees and hips or help propel the legs, the systems present significant barriers between the patient and the therapist.

In other systems, the subject is required to physically drag the cart with them as they ambulate. Accordingly, rather than being able to focus on their own balance, posture, and walking ability, the subject is forced to compensate for the dynamics of the cart. For example, on a smooth flat surface, if the subject stops abruptly, the cart can continue to move forward and potentially destabilize the subject. This confounding effect may result in an abnormal compensatory gait strategy that could persist when the subject is removed from the device.

Another problem with some conventional systems is that they only provide static unloading to a subject. That is, under static unloading, the length of the shoulder straps is set to a fixed length, so the subject either bears all of their weight when the straps are slack or no weight when the straps are taught. Static unloading systems have been shown to result in abnormal ground reaction forces and altered muscle activation patterns in the lower extremities. In addition, static unloading systems limit the subject's vertical excursions that prevent certain forms of balance and postural therapy where a large range of motion is necessary.

Some conventional systems include a motorized over-ground gait trainer. While the trainer is motorized and programmed to follow the subject's movement, due to the mechanics of the actuators and overall system dynamics, there are significant delays in the response of the system so that the subject has the feeling that they are pulling a heavy, bulky cart in order to move, a behavior that may destabilize impaired patients during walking. Also, the device cannot traverse over-ground obstacles, such as ascending or descending stairs and rough terrain, making it limited to smooth surface gait training.

In another conventional support system, there is a limitation on the amount of body-weight support that is provided. In such a system, the body-weight support cannot be modulated continuously, but rather is adjusted before the training session begins and is then fixed at that level.

Moreover, in some support systems, the extent of the vertical travel of the system is limited. As a result, subjects cannot be raised from a wheelchair to a standing position, thereby restricting the use of the system to individuals with only minor to moderate gait impairments. Also, while the trolley of a support system may be fairly light, the subject must pull it along the over-head rail as they ambulate. As a result, the subject will feel the presence of a mass. Furthermore, the amount of unloading cannot be adjusted continuously since it requires the operator to manually increase the pressure in the actuator. Finally, the system does not monitor and store quantitative data of gait performance (e.g. subject's walking speed, distance walked, etc) so tracking improvements in gait is not possible.

Thus, there is a need for an improved body-weight support system that overcomes the limitations of the systems described above.

SUMMARY OF THE INVENTION

The system of the present invention is a novel body-weight support system that allows individuals with severe gait impairments to practice over-ground walking in a safe, controlled manner. This system includes a body-weight support system that rides along a driven trolley.

As the subject or individual ambulates, the trolley automatically moves forward or backwards, staying above the subject so that they only feel a vertical unloading force. Because the system is mounted over-head, subjects can practice walking on uneven terrain and stairs, and subjects can use walking aids such as walkers or canes. In addition, since the system can maintain constant rope force under large vertical excursions, subjects can practice postural tasks and sit-to-stand maneuvers.

Furthermore, because of the instrumentation of the body-weight support system, the software tracks the distance walked, the walking speed, falls prevented, and unloading forces within and across multiple sessions. Using the body-weight support system, individuals with gait impairments can begin practicing walking early after their injuries, in a safe, controlled manner while their improvements can be tracked over time.

DETAILED DESCRIPTION

Figure 1:
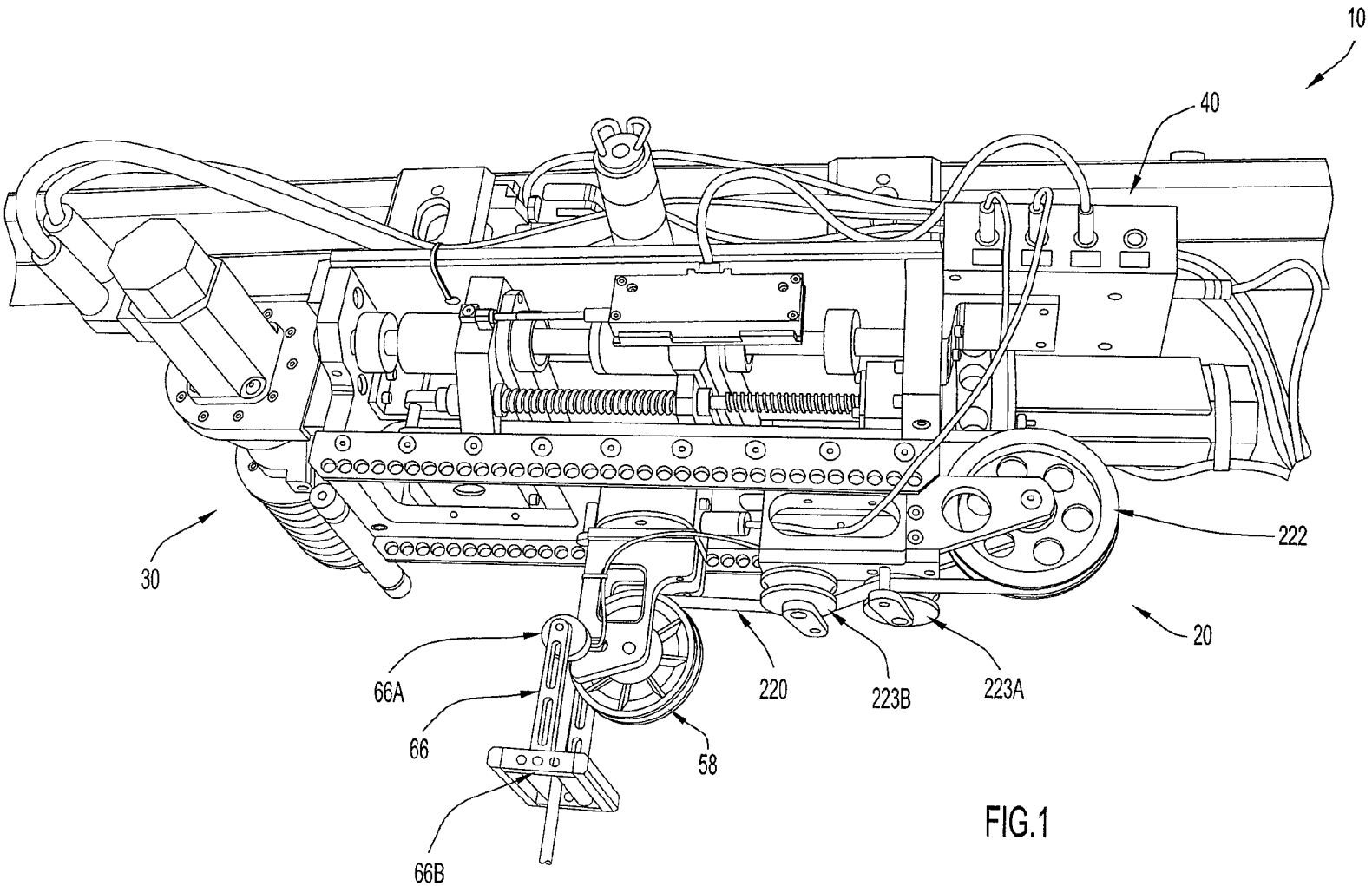
FIG. 1 is a bottom perspective view of an embodiment of a body-weight support system according to the present invention.

The system according to the present invention is a body-weight support system that allows individuals with severe to minor gait impairments to freely practice over-ground walking in a safe, controlled manner. The system 10 includes an unloading system 20 (see FIG. 1) that is attached to a driven trolley or movable support 30 that rides along a track 40, which in one implementation, can be mounted to a ceiling or other support structure. The track 40 includes straight sections as well as curved paths, allowing a subject 15 (see FIGS. 3 and 4) to practice walking around and/or over obstacles. In various embodiments of the invention, the track 40 may include any configuration and any combination of track sections.

As the subject 15 ambulates, the trolley 30 automatically moves forward or back, staying above the subject 15 so that the subject 15 only feels a vertical unloading force and does not have to drag the mass of the trolley 30. The system can maintain up to a certain amount of constant rope tension and can provide a certain amount of static unloading. In one embodiment, the system can maintain approximately 150 lbs of constant rope tension (e.g. constant force range: 0-150 lbs), and can provide 300 lbs of static unloading. In one embodiment, the system has over 12 feet of vertical travel, allowing patients to be raised or lowered to the floor, or from their wheelchair. In other embodiments, the range of travel of the system can vary. In addition, in other embodiments, the amount of rope tension and static unloading can vary.

Since the system 10 is mounted over-head (e.g. the trolley rides along a track mounted to the ceiling), subjects 15 can practice walking on uneven terrain and steps (see FIG. 4), and subjects can use walking aids such as walkers or canes. As described below, the system also has a user-friendly interface 100 (see FIG. 5), allowing the therapist to fully control the system not only at the control station, but also wirelessly through a pocketPC that can be clipped to their belt or other article. This configuration allows the therapist to remain at their patient's side at all times, encouraging patient-therapist interaction. Furthermore, because of the instrumentation of the system, the software tracks distance walked, walking speed, and unloading forces within and across sessions (see FIGS. 5 and 6).

In one embodiment, the system has extensive safety features that constantly monitor the status of the patient during training sessions and provide a high level of security to the subject being trained. The subject's vertical height is monitored using the system's instrumentation. In one embodiment, if at any time a fall is detected, the system automatically adjusts the unloading force so that the subject will descend a minimal distance, which in one implementation is not more than four inches. In another embodiment, if at any point the vertical height of the subject falls more than four inches or if their vertical speed moves faster than ten inches per second, the system automatically switches into a holding mode and prevents the subject from descending. If the desired unloading force moves outside +/−10%, the system also switches into a safe holding mode. In one embodiment, both the winch motor and the ball-screw or spring motor (each of which is described in detail below) have fail-safe brakes so that in the event of power loss, the brakes lock and the subject cannot fall. During perceived falls, the trolley 30 also will automatically slow the forward or backward progression of the patient until equilibrium is achieved. Using this system, individuals with gait impairments can begin practicing walking early after their injuries, in a safe, controlled manner.

Figure 2:
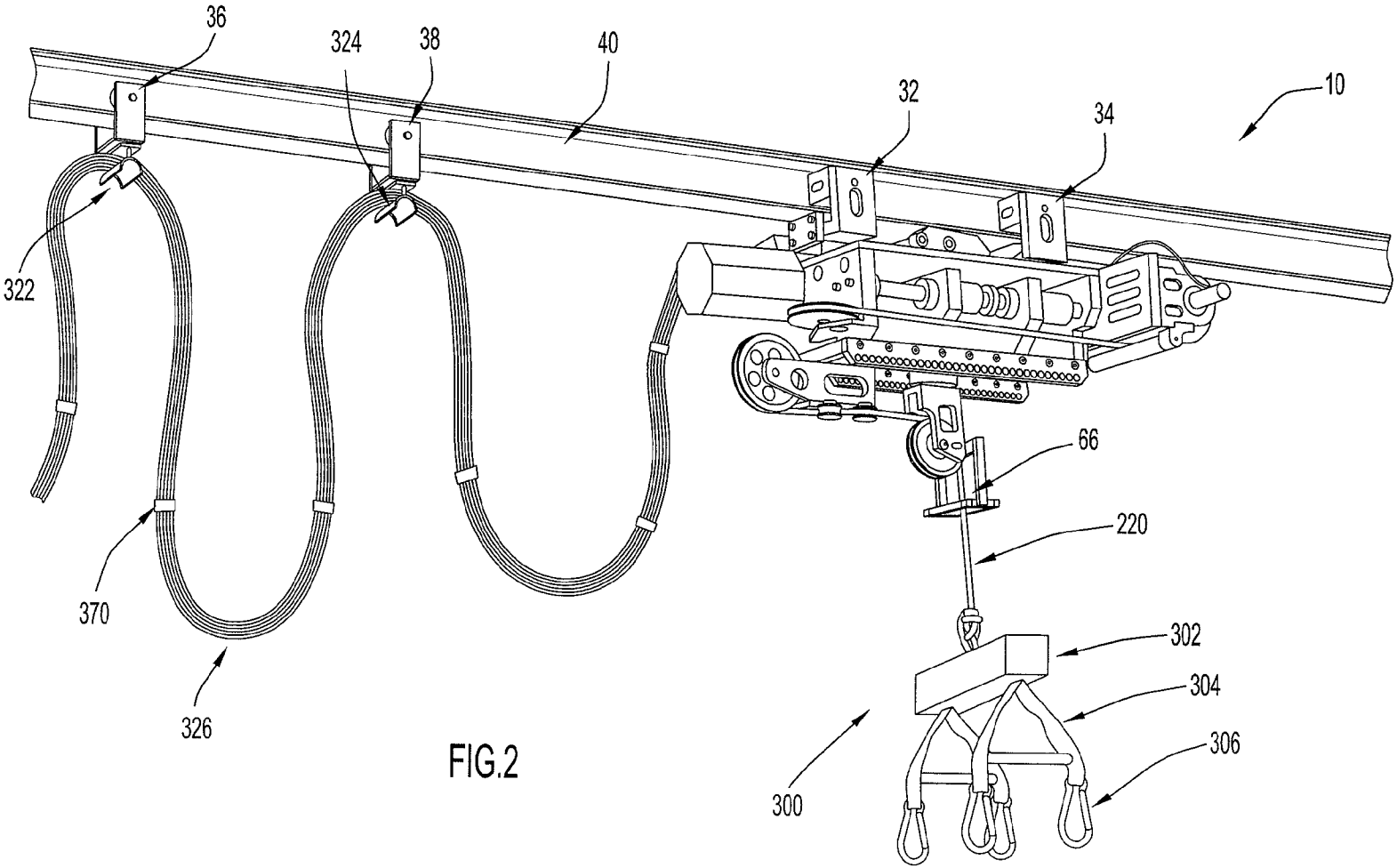
FIG. 2 is another perspective view of the body-weight support system illustrated in FIG. 1.
Figure 3:
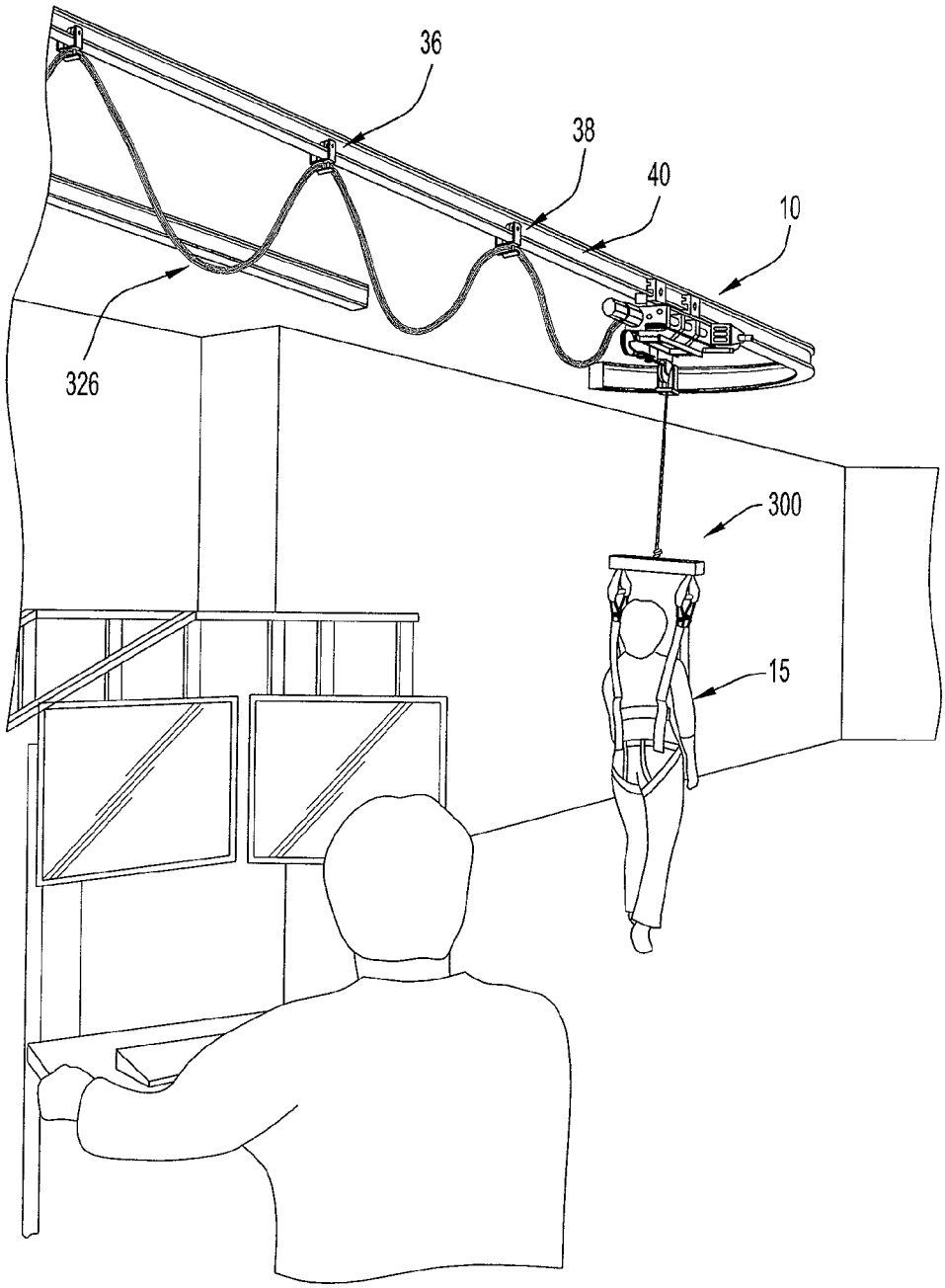
FIGS. 3 and 4 are different views of the body-weight support system illustrated in FIG. 1 in use.
Figure 4:
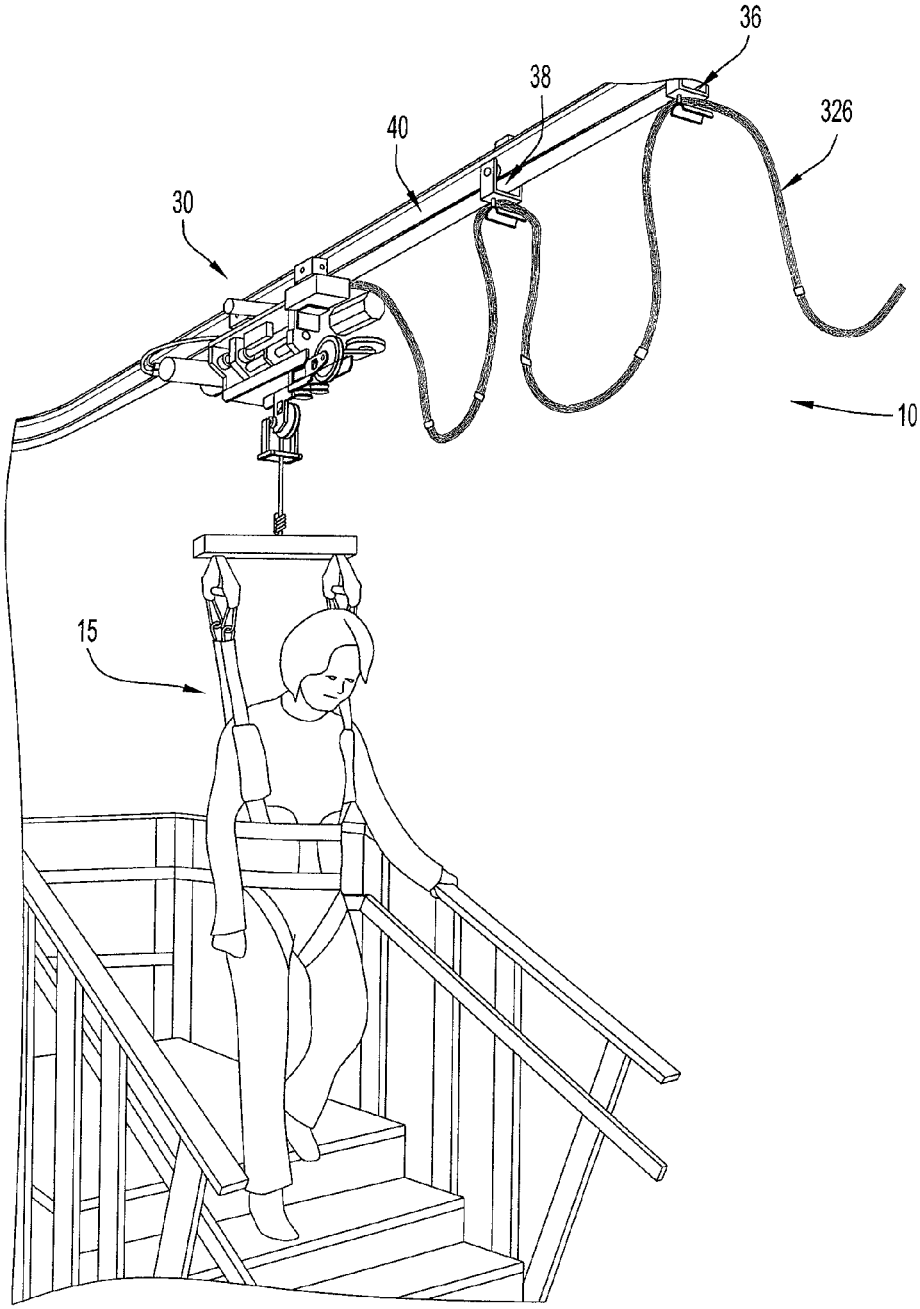

Referring to FIGS. 1-4, an embodiment of the over-ground body-weight support system according to the present invention is illustrated. FIGS. 1 and 2 show side perspectives of the body-weight support system 10. FIGS. 3 and 4 show subject training over-ground and descending stairs, respectively.

Referring to FIG. 1, the unloading or adjustment system 20 includes a pulley 222 around which a rope 220 passes. Rope 220 can be referred to alternatively as an elongate member. The rope 220 has one end that is coupled to a winch as described below and another end that is coupled to a support assembly, such as a harness system or assembly, as described below. The support assembly and the elongate member, in this example the rope 220, form a suspension system that can be used to support a person or subject. The rope 220 passes around other pulleys 223A and 223B that guide the rope 220 toward pulley 58. The rope 220 passes around pulley 58 and through a pivotally mounted arm 66 that has an upper end 66A and a lower end 66B. The function and use of arm 66 is described in detail below with respect to FIGS. 15 and 16.

Referring to FIG. 2, several other portions of the body-weight support system 10 are illustrated. In this embodiment, the body-weight support system 10 includes wheel assemblies 32 and 34 that have wheels coupled thereto and that are pivotally mounted to the trolley 30. The wheels assemblies 32 and 34 are configured to support the trolley 30 from the track 40 and move along the track 40. In addition, the system 10 includes several festoons (only festoons 36 and 38 being shown in FIGS. 2 and 3) that are movably mounted on the track 40. Each of the festoons 36 and 38 includes rotatably mounted wheels that support the festoons 36 and 38 on the track 40. Festoons 36 and 38 include support members 322 and 324, respectively, coupled thereto that provide support for one or more cables and/or wires 326. The cables and/or wires 326 are connected to the electrical system on the trolley 30 and as the trolley 30 moves back and forth along the track 40, the cables and/or wires 326 bunch up into loops 370 and the festoons 36 and 38 move along the track 40 as well.

As shown in FIG. 2, the lower end of the rope 220 that passes through or proximate to arm 66 is coupled to a support system 300. The support system 300 includes a support bar 302 from which straps or other members 304 are supported. Coupled to the straps 304 are various clips 306 to which a harness system placed on a subject or patient can be coupled. In different embodiments, clips 306 can be replaced by buckles or other similar structures.

Referring to FIGS. 3 and 4, the body-weight support system 10 is illustrated in use by a subject 15 walking along a track 40 and walking down stairs. The body-weight support system 10 can be used with any track configuration and any combination of obstacles. In one embodiment, the body-weight support system 10 can be used with a treadmill.

Figure 5:
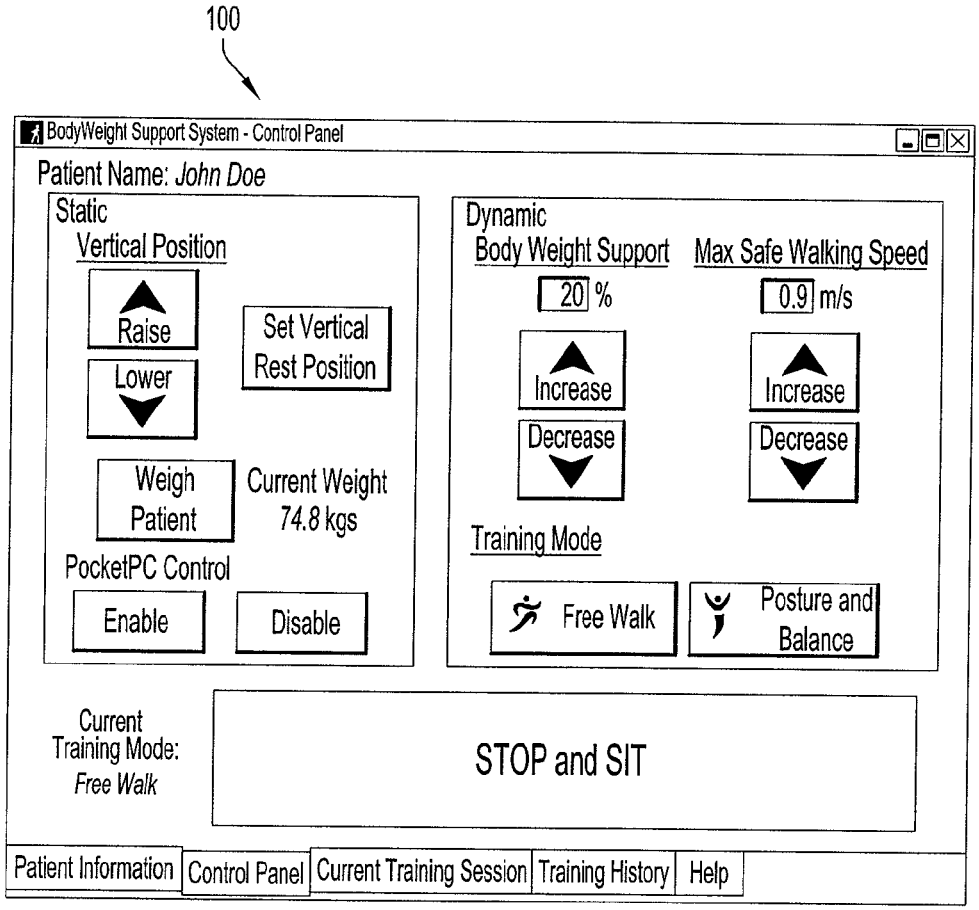
FIG. 5 is an exemplary user interface of the body-weight support system illustrated in FIG. 1.
Figure 6:
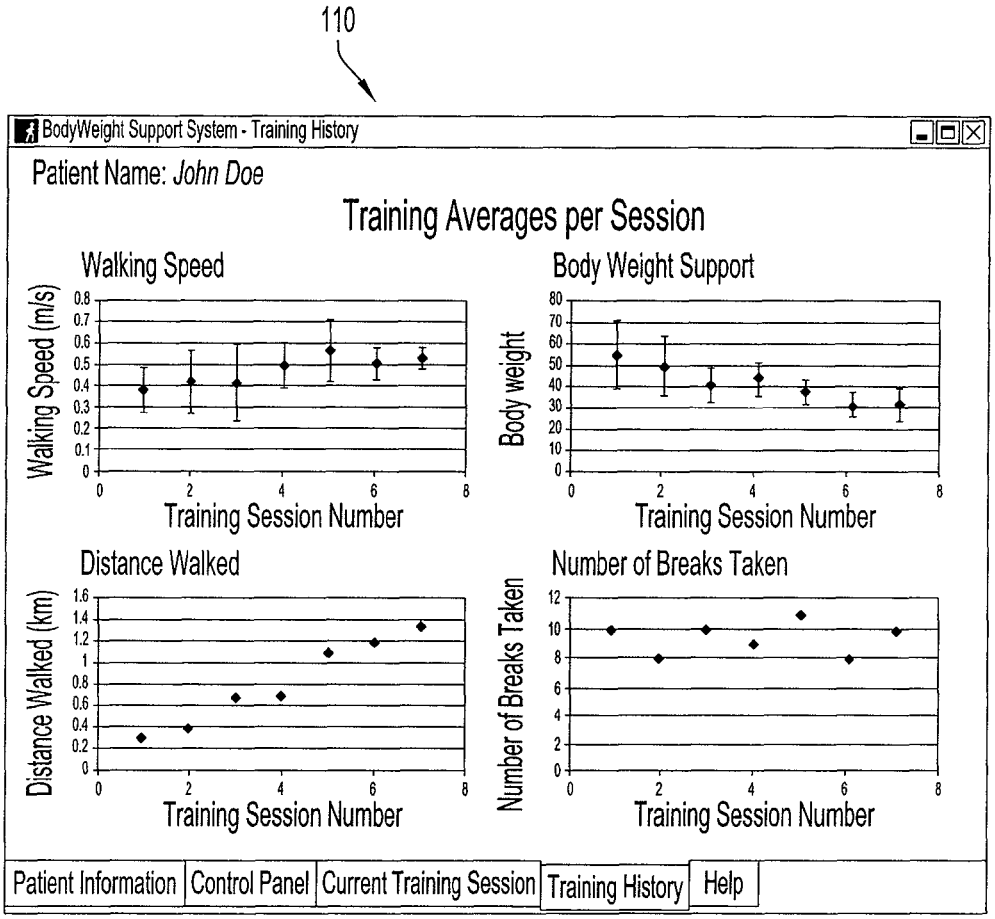
FIG. 6 is an exemplary data tracking screen of the body-weight support system illustrated in FIG. 1.

Referring to FIGS. 5 and 6, some of the interface components are illustrated. In particular, the user interface 100 (see FIG. 5) allows a therapist to control all aspects of the system while the device tracks patient performance within and across training sessions (see interface 110 of FIG. 6). The user-interface 100 allows the therapist to monitor and control all of the features of the system 10. Large push buttons on a touch-screen such as that shown in FIG. 5 allow the therapist to raise and lower the patient, to start the constant body-weight support, engage the trolley (e.g. have the trolley track the subjects). Data is stored for each training session to monitor improvements in a number of important metrics, such as average walking speed, level of body-weight support, rest breaks, session time, walking time, and falls prevented.

In addition to a touch-screen user interface, the system can also be controlled wirelessly through a pocketPC. This feature allows the therapist to maintain full control over the unloading system at any point along the rail system is a wireless pocketPC interface computer. For example, a situation may occur in which after ambulating down the track, the subject states that they need more body-weight support. Rather than requiring the therapist to run back to the Host Computer to change the body-weight support settings, which would ultimately compromise the safety of the patient, they can simply unclip the pocketPC from their belt and increase the level of support. This in turn sends a wireless signal back to the Host Computer, which will adjust the body-weight support system settings accordingly.

Referring to FIG. 5, the various components of an embodiment of a user interface according to the present invention are illustrated. FIG. 5 shows an embodiment of a control panel user interface. As shown, a user can adjust the vertical position of a subject and the body weight support provided to a subject. Also, a user can control the walking speed of the subject. The particular training mode of operation determines whether the trolley 30 should track the subject (e.g., a self-paced mode), move at a constant speed (e.g., a paced mode) or hold its position for posture and balance tasks. In addition, a user can enable or disable the pocketPC device used by the therapist.

Referring to FIG. 6, an embodiment of a training history graphical user interface is illustrated. In this embodiment, data related to the walking speed, the body weight support, the distance walked, and the number of breaks taken has been collected and is presented in graphical form for ease of reference by a user or therapist.

Figure 7:
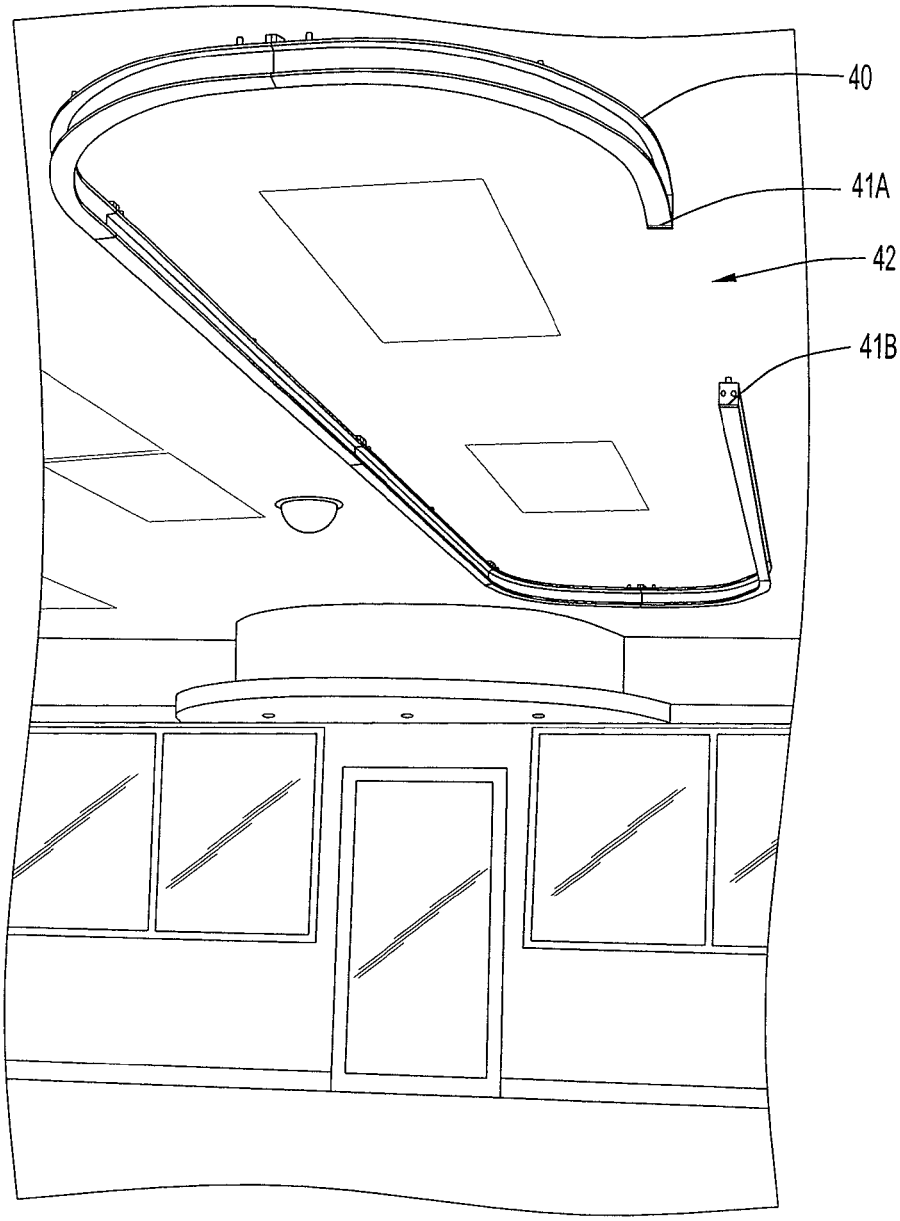
FIG. 7 is a bottom perspective view of an embodiment of a track system according to the present invention.

The unloading system 20 mounted to the trolley 30 of the body-weight support system rides along a track 40 that is mounted to the ceiling 42 of the facility. In one embodiment, the track 40 is preferably mounted to the concrete deck in the floor above where the system will be mounted (e.g. from a second floor deck if system is to be used on a first floor). The shape of the track can include straight sections as well as curved paths. This configuration or arrangement allows patients to practice walking straight paths, as well as around obstacles. Referring to FIG. 7, an exemplary track 40 is shown. In this embodiment, the track 40 extends from end 41A to end 41B and includes several curved sections and several straight sections.

The "path" that the patient must walk within lies directly beneath the track. In one embodiment, the "path" normally spans approximately two feet in width. The width of the path that the subject walks within is a function of the ceiling height and the amount of unloading force. The complete track is made custom for each facility, selected by the facility based on the available space and also preference. For example, one facility may choose to have a fifty foot straight section followed by some curves. Another facility may select a twenty-five foot straight section only, with no curved paths. In one implementation, the minimum radius of curvature for the curved sections is approximately two feet.

The trolley 30 rides along the track 40 and allows for forward and backward progression of the subject 15. The wheels on the trolley 30 are pivoting, thereby allowing the system to navigate corners as well as straight sections. In one embodiment, the trolley 30 includes pivoting wheel assemblies 32 and 34 that are pivotally mounted to a plate or base. In the embodiment illustrated in FIG. 12, a direct current (DC) motor 50 is mounted between the front and back trolley wheels or wheel assemblies 32 and 34. In another embodiment, a DC motor is mounted to one of the pivoting wheel assembles 32 or 34. The motor 50, including a gearhead, is utilized to drive the system via a motor drive wheel 52. The terms "motor," "drive," and "drive mechanism" can be used interchangeably herein. As shown in FIG. 13, a spring 56 pushes the drive wheel 52 against the bottom of the I-beam of the track 40. In particular, the spring 56 pushes a movably mounted bracket 54, to which the motor drive wheel 52 is mounted, toward the track. Thus, the drive wheel 52 contacts the I-beam track 41 beneath the lower flange 46C (as described below).

In this setting, the rope of the unloading system hangs down through a pivoting arm and connects to the patient's harness. On the pivoting arm is a sensor or detector that measures the angle of the rope. The terms "sensor" and "detector" can be used interchangeably herein. As the subject steps forward, this causes the pivoting arm to rotate, which is detected by the sensor on the pivoting arm. The trolley motor 50 is turned on, driving the trolley forward or backward, until the rope is vertical (e.g. the patient is directly below the trolley). In this setting, the subject does not have to drag the trolley along but instead the trolley automatically tracks the subject (e.g. stays directly above them) using the motor. The motor can also be used to maintain the trolley in a fixed position along the track if the therapist wants to do postural training, and can limit the subject's over-ground walking speed if the therapist feels the subject should not walk beyond a particular speed. In this setting, the trolley will stay above the subject as long as they walk below a pre-set speed. If the subject tries to walk faster, the trolley will only move at the pre-set speed, effectively slowing down the patient's forward progression. The trolley 30 can also be set to move at a constant walking speed, where the trolley 30 moves at this selected speed as long as the subject is in front of, under, or slightly behind the trolley 30. If the subject lags too far behind the trolley 30, the system assumes that the subject cannot keep up at that speed and the system 10 will stop.

A high-resolution sensor that is mounted to one of the wheels on the pivoting wheel assemblies 32 and 34 measures the rotation of the wheel in order to monitor how far the subject has walked and also their walking speed.

In one embodiment, the track system includes an I-beam 41 that is mounted to the concrete sub-floor above the floor where the system will operate (e.g. if the system is used on the first floor, the beam hangs from the bottom of the second floor deck). The I-beam 41 can also be mounted to the building's main beam structures if access to a concrete upper deck is not available. In one embodiment, the I-beam track 40 can be ceiling-mounted as shown in FIG. 7. Some of the features of the track are illustrated in engineering drawings showing mounting details for supporting straight and curved sections of I-beam track (see FIGS. 8A-8J and 9A-9C). The mounting components can include a steel strut with lateral brace supporting I-beam, not visible, below drop-down ceiling (see FIG. 10) and tubular steel anchors bolted to concrete sub-floor (see FIG. 11).

Figure 9A:
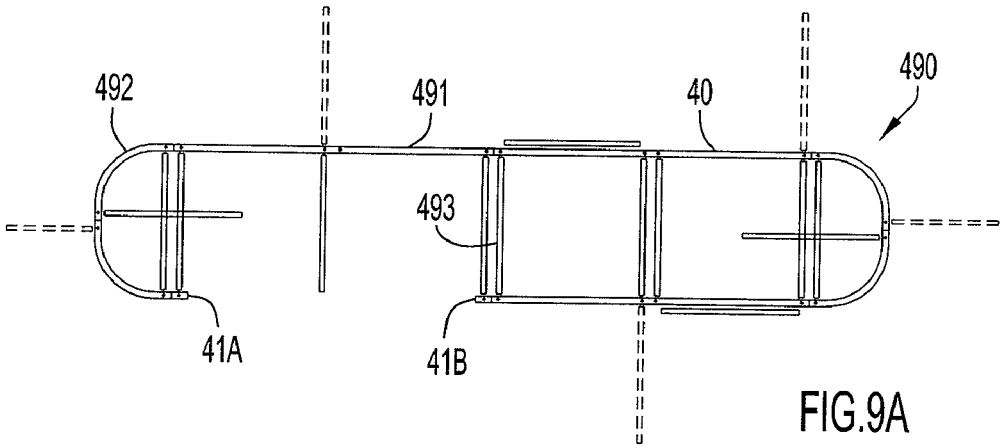
FIGS. 9A-9C are various views of mounting structures for the track system illustrated in FIG. 7.
Figure 9B:
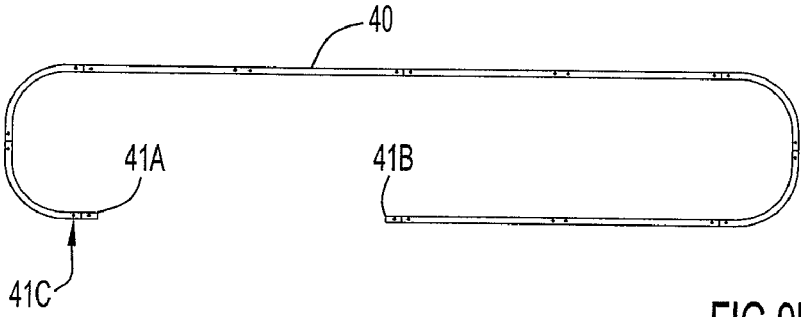
Figure 9C:
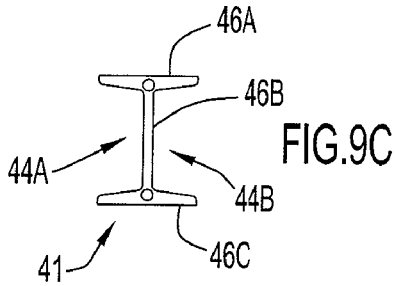
Figure 10:
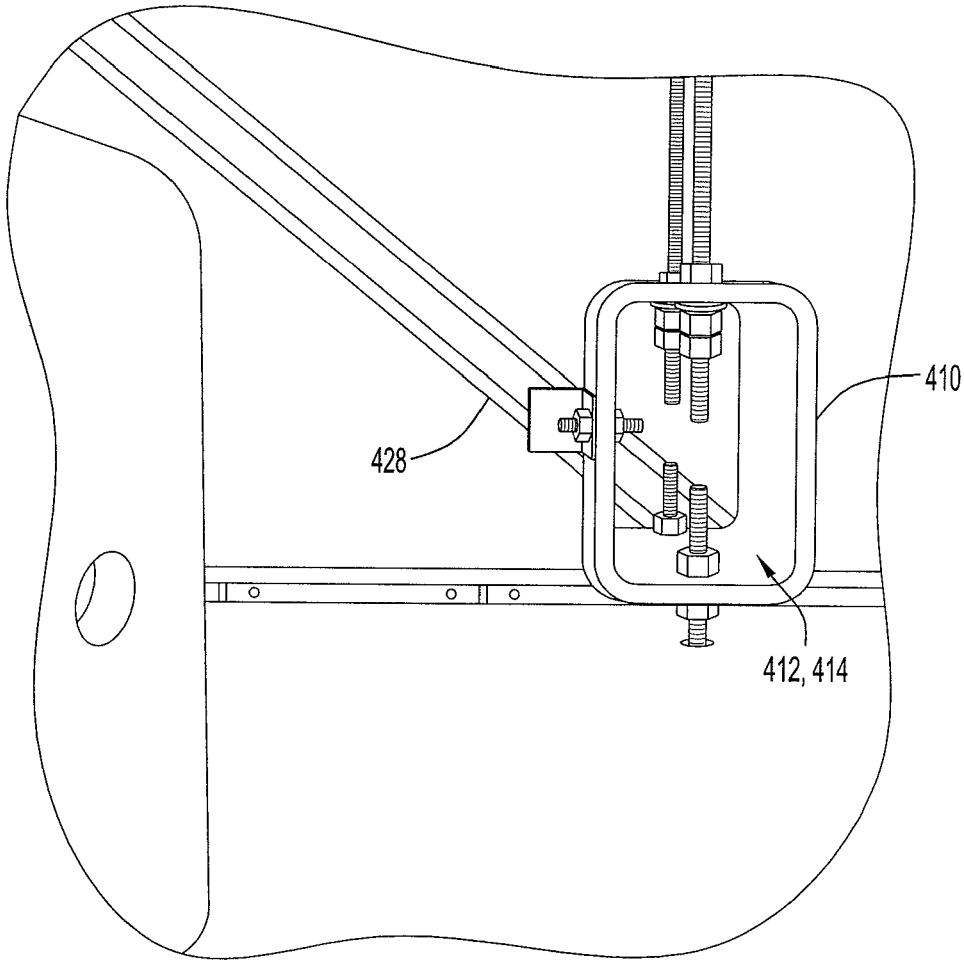
FIGS. 10 and 11 are views of several components of the track system illustrated in FIG. 7.
Figure 11:
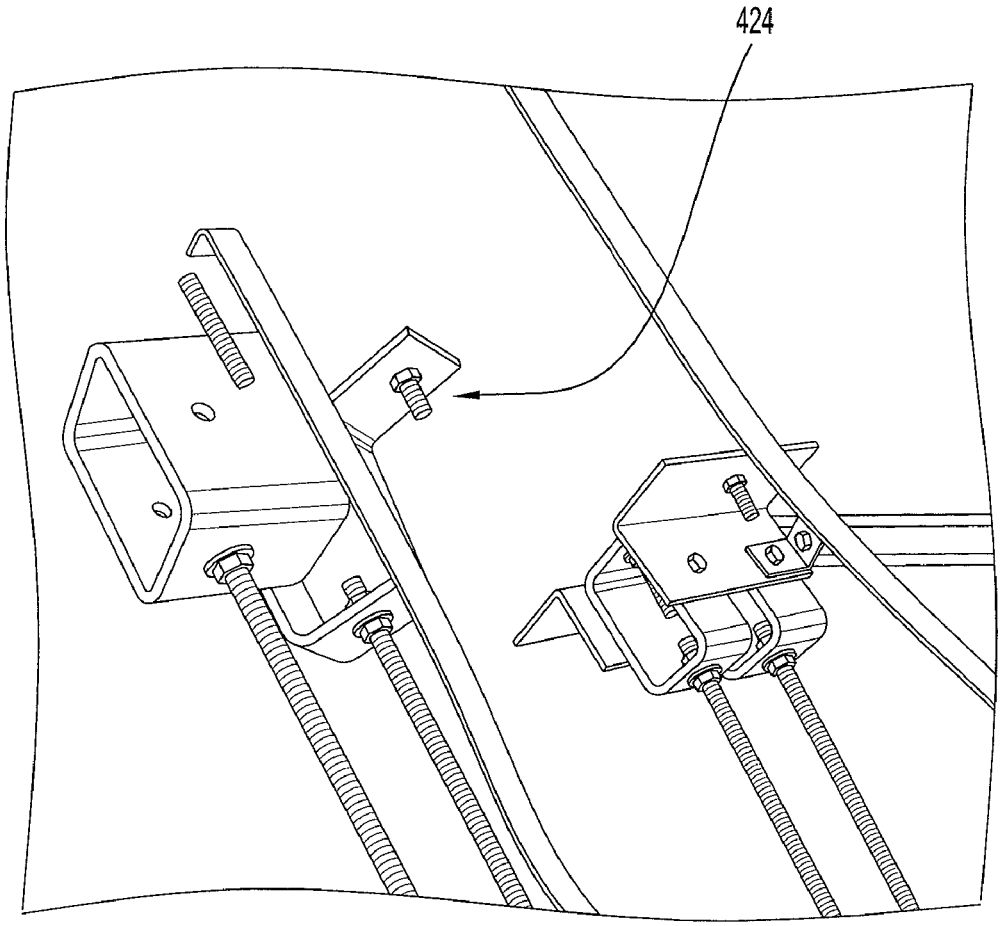

Anchors are first placed in the concrete floor above the floor of operation, after which long threaded rods are fastened to the anchors (see FIGS. 10 and 11). These threaded rods hang down from the deck to just above the ceiling of system operation, and are fastened to box-section support brackets (see FIGS. 8A-8J and 9A-9C, which are schematics of the mounting structure for the I-beam track). Threaded studs are welded onto the top of the I-beam, which extend up through the ceiling and attach to the bottom of the suspended support brackets (see FIG. 10). This modular mounting system can accommodate air ducts, electrical systems, and plumbing lines since the threaded rods that descend from the concrete sub-floor can simply be repositioned as necessary. As shown in FIG. 7, the track can consist of straight sections as well as curved sections, allowing patients the opportunity to practice walking around obstacles.

Referring to FIGS. 8A-8D, two different portions of an I-beam being supported are illustrated. The I-beam 41 is supported by connectors 412 and 414, such as bolts, that are coupled to a box section support member 410. The box section support member 410 is supported by connectors 416 and 418 that are coupled to support members 420 and 422 that are secured to a support portion 430, such as a concrete ceiling or slab. An angled support 428 can be provided for additional lateral support to the support system. The angled support 428 can be coupled to a box section support member 410, to a support member 420 and/or to a bracket 432. In other embodiments, any combination of these components can be used to support a portion of a track 40.

Figure 8A:
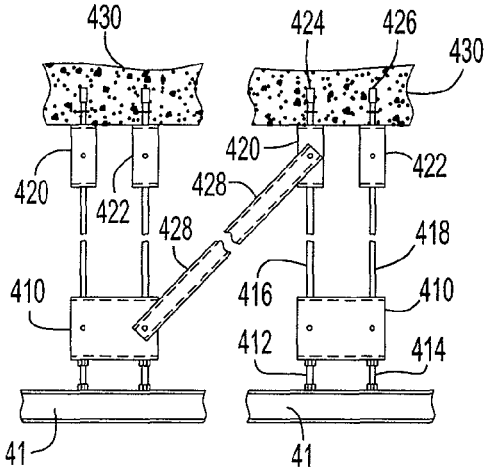
FIGS. 8A-8J are various view of mounting structures for the track system illustrated in FIG. 7.
Figure 8B:
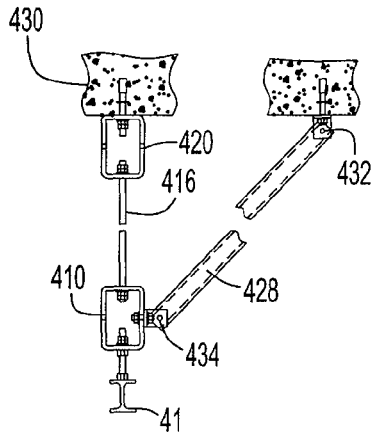
Figure 8C:
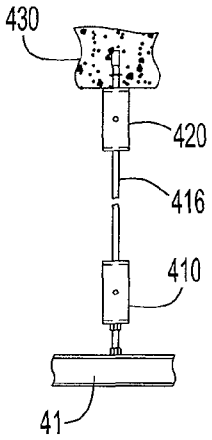
Figure 8D:
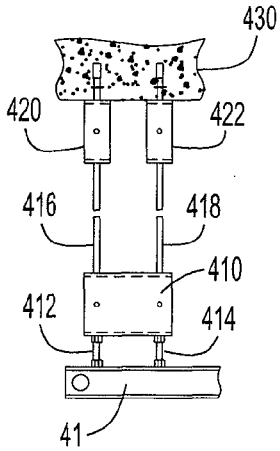
Figure 8E:
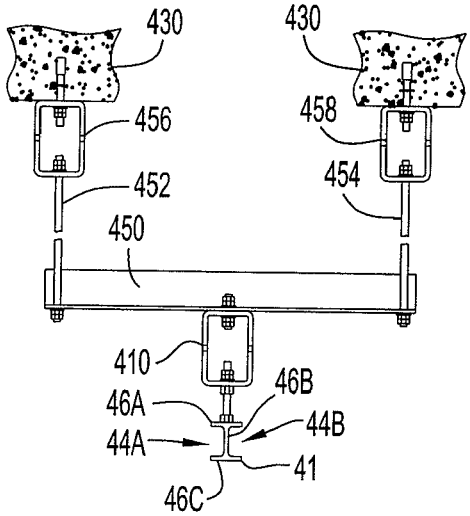
Figure 8F:
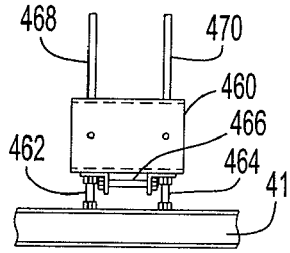
Figure 8G:
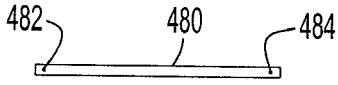
Figure 8H:
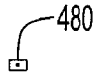
Figure 8I:
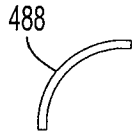
Figure 8J:
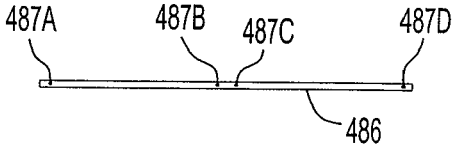

Referring to FIGS. 8E and 8F, a track portion 41 with an I-beam configuration is illustrated. In this embodiment, the track portion 41 is supported by a box section support member 410 that is fastened to a rail portion 450. The rail portion 450 is supported by connectors 452 and 454 that are fastened to box section support members 456 and 458. As shown in FIG. 8F, a connector 466 can be provided between connectors 462 and 464 for additional support relative to member 460. Connectors 468 and 470 can be coupled to box section support members (not shown in FIG. 8F).

FIGS. 8G-8J illustrate various track components or sections that can be used to build a track. Track component 480 includes mounting holes 482 and 484 proximate to its ends. While track component 480 is straight, curved portion 488 can be used as well (see FIG. 8I). Track component 486 includes mounting holes 487A and 487D proximate to its ends and mounting holes 487B and 487C near its middle section. Connectors can be used with the mounting holes to support the track component or section.

Referring to FIGS. 9A-9C, additional features of an embodiment of a track according to the present invention are illustrated. In FIG. 9A, track 40 includes straight portions 491 and curved portions 492 to form a path from end 41A to end 41B. Various braces 493 can be provided for support of the track. The track sections can include mounting holes 41C (see FIG. 9B) through which connectors can pass. Referring to FIG. 9C, an embodiment of a track section according to the invention is illustrated. In this embodiment, the track section has an I-beam configuration 41 with an upper flange 46A, a lower flange 46C, and a middle section 46B. Channels or areas 44A or 44B are formed on opposite sides of the middle section 46B.

Referring to FIG. 10, note that the angled support 428 provides side-to-side stability for the I-beam (see FIG. 8). As shown in FIG. 10, threaded rods 412 and 414 welded to the I-beam stick up through the ceiling tiles and connect to the box-section support members 410 hanging from the concrete sub-floor. Referring to FIG. 11, studs 424 anchored into the concrete sub-floor extend out and connect to the top of box-section supports. Rods extend from the bottom of these supports, down to lower box-section supports located just above the ceiling tiles (see FIG. 10).

Figure 14:
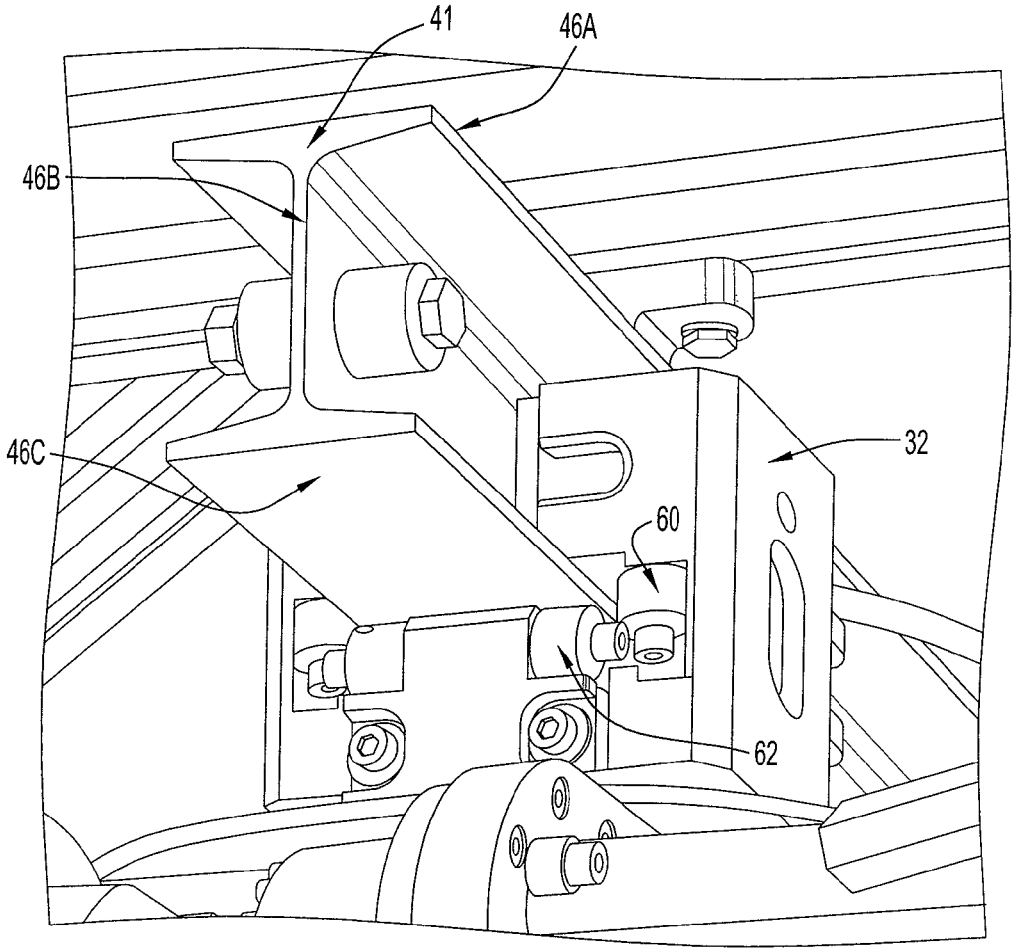

As described above, In one embodiment, the body-weight support system 10 includes a trolley 30 that moves along the track 40. The trolley 30 of the body-weight support system 10 allows subjects to practice walking over-ground by rolling along the track 40 as described above. The unloading system 20 that supports the patient is mounted beneath the trolley 30, as described in detail later. Two large pivoting wheel assemblies 32 and 34 allow the trolley 30 to roll along the I-beam 41 (see FIG. 12). Each wheel assembly includes two large wheels that fit inside the web of the I-beam 41, preventing the trolley 30 from moving up or down or having any vertical movement. Small wheels located on the bottom (see wheels 60) and sides (see wheels 62) of the pivoting wheel assemblies engage the I-beam lower flange 46C prevent the trolley 30 from wobbling or torquing to one side (see FIG. 14). The wheel assemblies 32 and 34 pivot, allowing the trolley 30 to traverse curves on the I-beam 41 (see FIG. 7). Referring to FIG. 14, small wheels 60 and 62 mounted just outside the lower beam flange 46C and just below the flange 46C provide the trolley 30 stability as it moves along the I-beam track 40.

Figure 12:
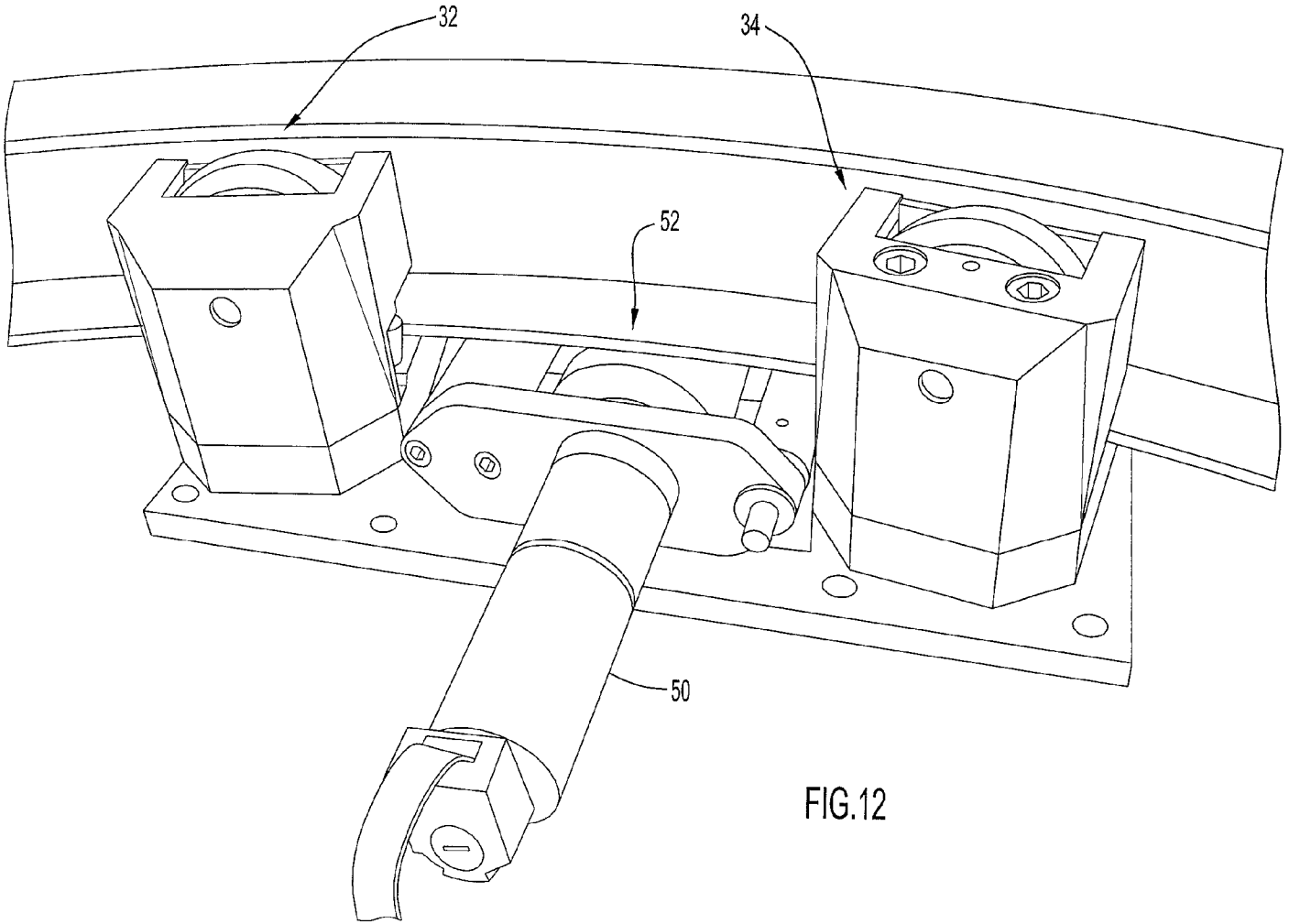
FIGS. 12-14 are views of some of the components of the body-weight support system illustrated in FIG. 1, some of which are showing engagement with the track system.
Figure 13:
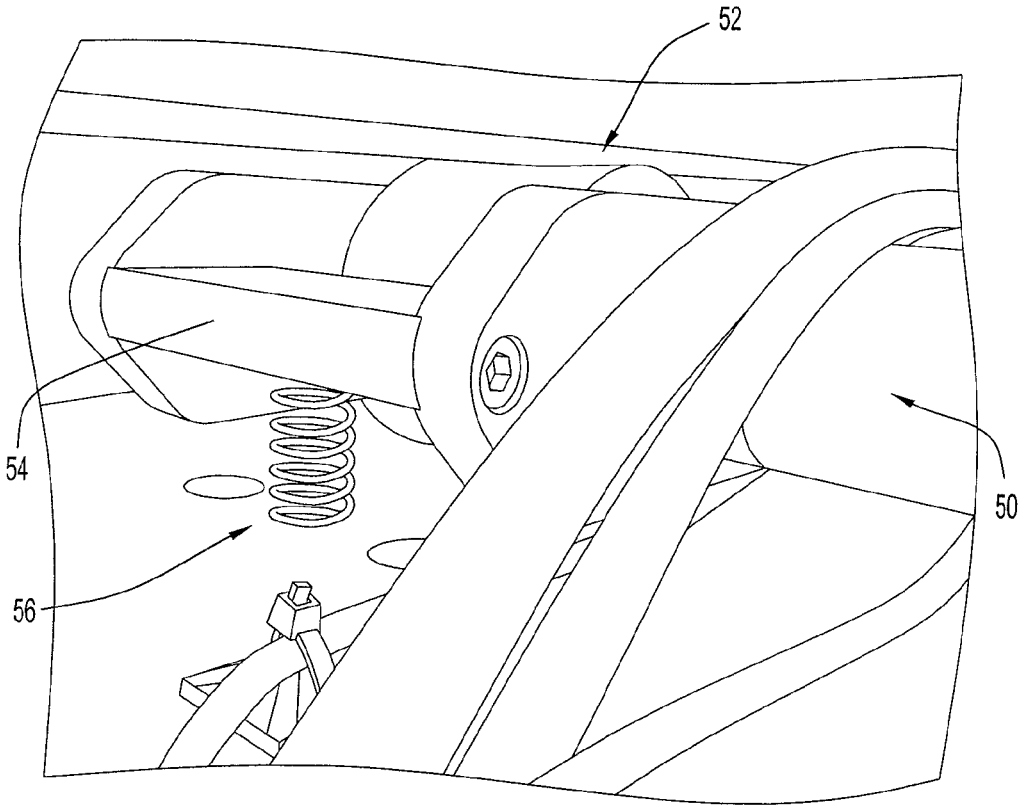

The trolley 30 is actuated by a drive wheel 52 located on one of the two pivoting wheel assemblies 32 and 34, which in turn is connected to a DC motor (an exemplary motor is manufactured by Maxon USA) (see FIGS. 12 and 13). In an alternative embodiment, the drive wheel on the trolley 30 can be located between the two pivoting wheel assemblies. The drive wheel 52 is made of a high-durometer rubber to provide adequate traction on the I-beam 41. Heavy-duty springs 56 push the drive wheel 52 against the lower flange 46C of the I-beam 41 (FIG. 13). The DC motor turns the drive wheel 52, which moves the trolley 30 along the rail or track 40.

Figure 15:
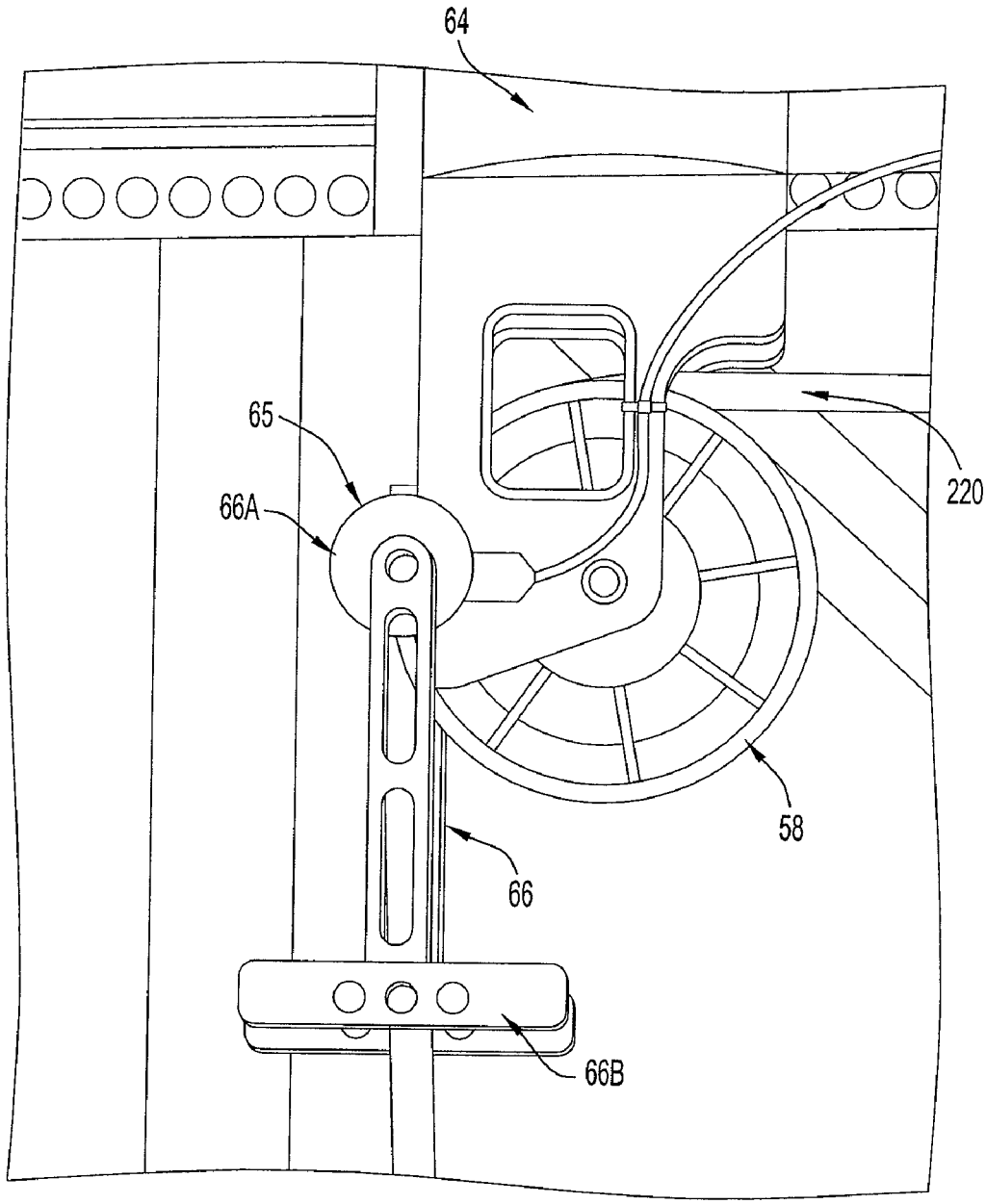
FIGS. 15-16 are views of some of the components of the unloading system of the body-weight support system illustrated in FIG. 1.
Figure 16:
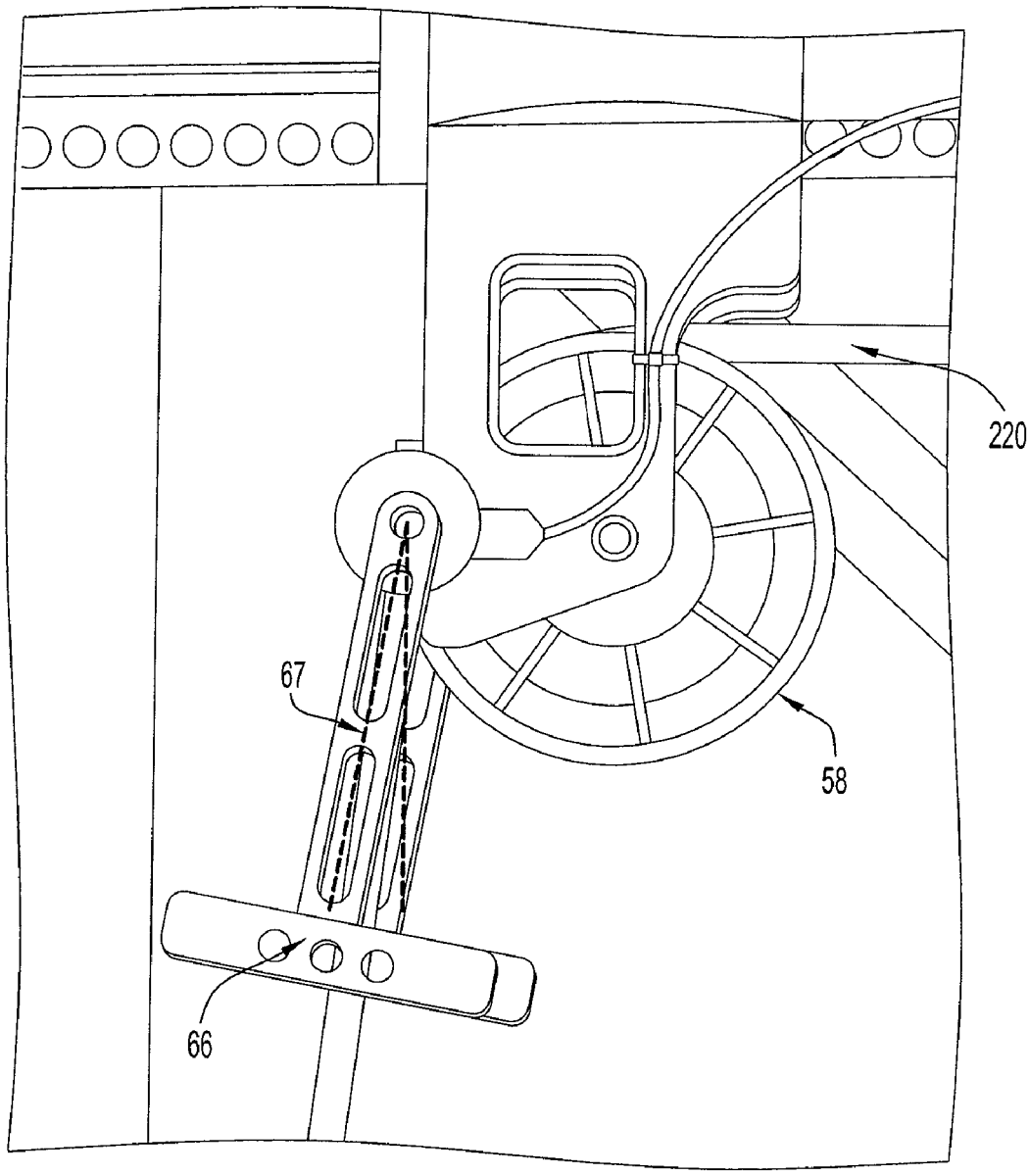

Referring to FIGS. 15 and 16, the unloading rope 220 feeds down to the patient through a pivoting arm 66, where the angle 67 of the arm 66 is measured using a precision potentiometer 65 (FIGS. 15 and 16). The unloading rope 220 is connected to the subject's harness and descends through or proximate to the arm 66. A computer closely monitors the angle of the pivoting arm relative to a vertical direction by reading the voltage of the potentiometer 65, and if the arm 66 is not vertical (such as shown in FIG. 15), the computer or controller turns on the trolley motor and drives the trolley 30 either forward or backward in order to make the angle zero (e.g. the unloading rope hanging vertical implying the trolley is directly over the subject's head). This adjustment process continues until the arm 66 is again vertical. Thus, as the subject walks, the rope 220 causes the pivoting arm 66 to pivot, which is measured by the potentiometer 65. In one embodiment, when the potentiometer or sensor 65 detects movement in a forward direction relative to the trolley, the drive mechanism is activated to cause movement of the trolley in the forward direction, and when the sensor detects movement in a rearward direction relative to the trolley, a braking mechanism is activated to retain the trolley in a particular position.

Referring to FIG. 15, the control system of the body-weight support system 10 according to the present invention includes a force sensor 64 that measures the force being applied to the rope 220.

Now, an embodiment of an unloading system of the body-weight support system according to the present invention is described. In this embodiment, the unloading system 200 has two main components: the winch and the spring-based dynamic unloading system.

A function of the winch is to raise and lower the subject into or out of a sitting position, or in some cases, bring a person up from or lower a person to the floor. The winch sub-assembly consists of a DC brushless motor, a harmonic drive gear head (80:1), and a winch drum spooled with approximately twelve feet of rope. In an alternative embodiment, the drive gear head may have a 100:1 ratio.

Figure 17:
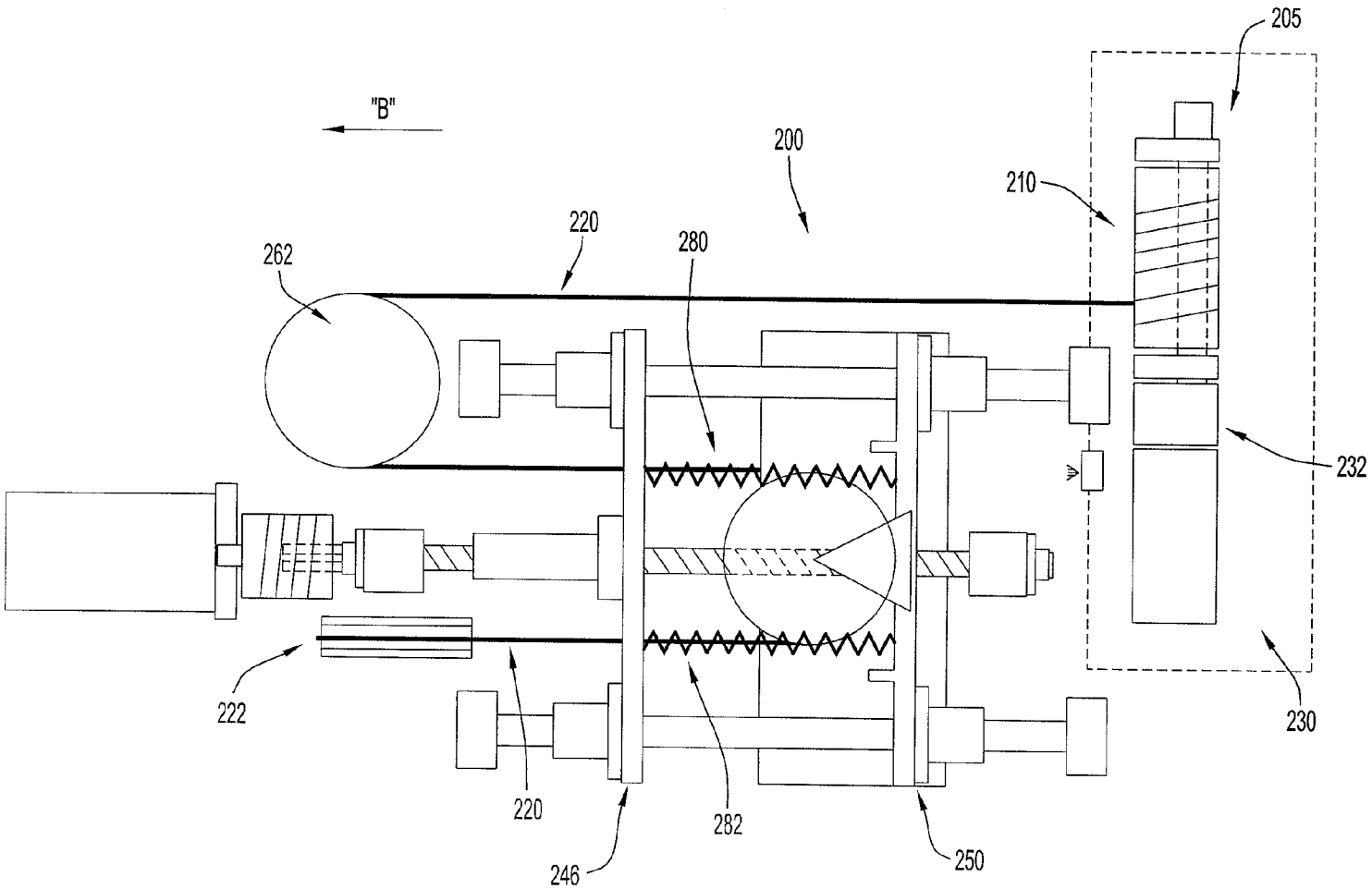
FIG. 17 is a schematic view of some of the components of the body-weight support system according to the present invention.

Referring to FIG. 17, the winch sub-assembly 205, which is shown inside the broken or dashed lines, allows large lengths of rope 220 to be spooled out or reeled in, which in turn, is used to raise or lower a patient from/to the floor or from/to a sitting position.

The unloading system 200 is the portion of the body-weight support system that raises and lowers the subject, and also provides constant rope tension (e.g. constant body-weight support). The unloading system 200 is mounted below the trolley 30, allowing it to move along the track 40. On the unloading system, a winch drum 210 is spooled with rope 220, which in one embodiment can be at least twelve feet of rope. The rope 220 can be an 8 mm rope. The rope 220 can be let out to lower the subject or wrapped up to raise the subject from the floor or their wheelchair. A DC motor 230 controls the function of the winch. Once the subject is in a standing position, the therapist can engage the constant body-weight support system 200. In this capacity, constant rope tension is maintained by two die-springs 280 and 282 pressing against the pulley plate 250 to which the subject is attached. As the subject walks, a DC motor 230 automatically maintains the spring length constant for springs 280 and 282, which results in constant rope tension. Sensors monitor the amount of unloading force and the subject's vertical position. The springs can be referred to as elastic members.

Now the operation of the winch is described. In one embodiment, the winch motor 230 turns at a constant speed, controlled by computer software, which is reduced by the harmonic drive by 80 times since a 80:1 gear ratio is utilized. The torque developed at the output of the harmonic drive is 80 times that of the motor due to this gear ratio. In an alternative embodiment, the speed can be reduced by the harmonic drive by 100 times if a 100:1 gear ratio is utilized. In other embodiments, different gear ratios can be used.

Figure 18:
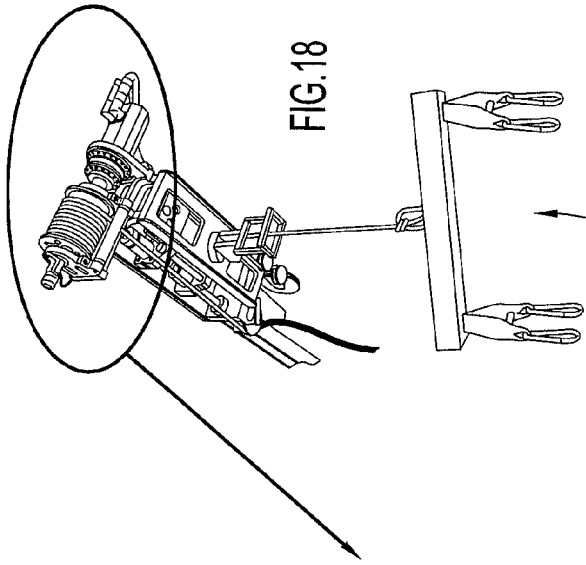
FIGS. 18 and 19 are perspective and close-up views, respectively, of some of the components of the winch of the body-weight support system illustrated in FIG. 1.
Figure 19:
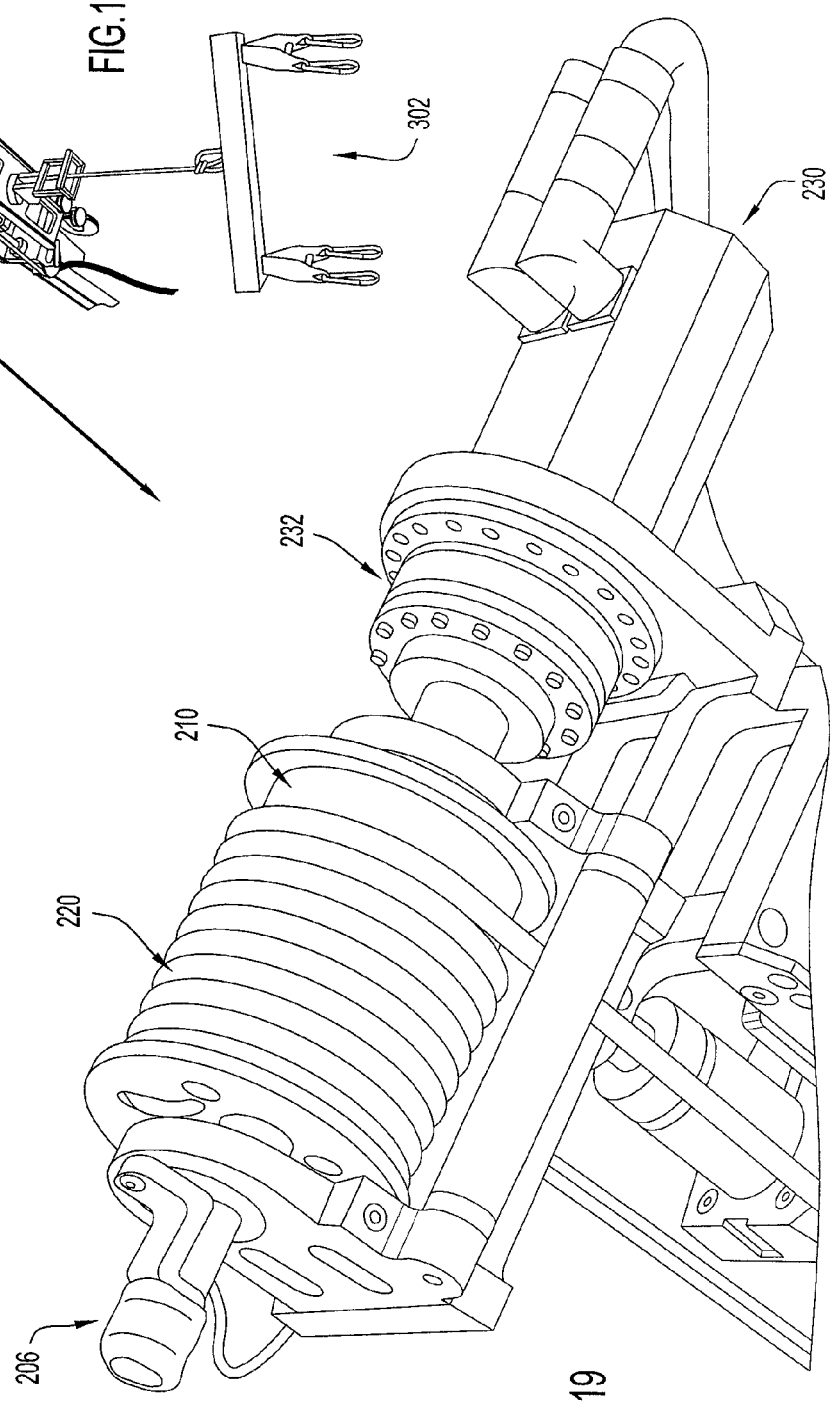

Since the harmonic drive 232 is coupled directly to the winch drum 210, the winch drum 210 turns at the same speed as the harmonic drive 282. As the winch turns in one direction, rope 220 is unwound from the winch drum 210 according to the path shown in FIG. 17 by arrow "B." As a result, the position of the spreader bar 302 and consequently the subject is lowered. If the winch turns in the opposite direction, rope 220 is wound onto the drum 210, effectively raising the position of the spreader bar 302 and consequently the subject (see FIGS. 18 and 19). A multi-turn potentiometer 206 is mounted to the end of the winch drum 210 that monitors the height of the spreader bar (or equivalently the subject). The vertical range of the spreader bar 302 is monitored in the software so that the control system always knows the vertical position of the subject.

Under normal operation, once the subject is raised to a standing position, the motor is turned off and maintains the current winch position using an internal motor brake. The winch is mainly used to raise and lower patients at the beginning and end of trainings, and also to pick up rope slack (or let rope out) if subjects are negotiating stairs or performing sit-to-stand maneuvers where a large vertical excursion is required. This is described more below. In one implementation, by using the current motor-harmonic drive, the winch can produce approximately 420 lbs of rope tension at a speed of 12.6 inches per second.

While the winch described above allows subjects to be raised and lowered from the floor and their wheelchairs, the spring-based-unloading system 200 controls the tension in the rope 220. The spring-based system can be referred to as a "series-elastic actuator." The overall concept of a spring-based system is that a spring compressed by some length, dx, will produce a force k*dx according to Hooke's Law, where k is the spring's stiffness. In order to maintain constant force, a motor is used to maintain the length of the spring at some fixed amount of compression. A detailed discussion of the operation of the spring-based unloading system will be presented below. First, a description of the parts of the system will be presented.

Figure 20A:
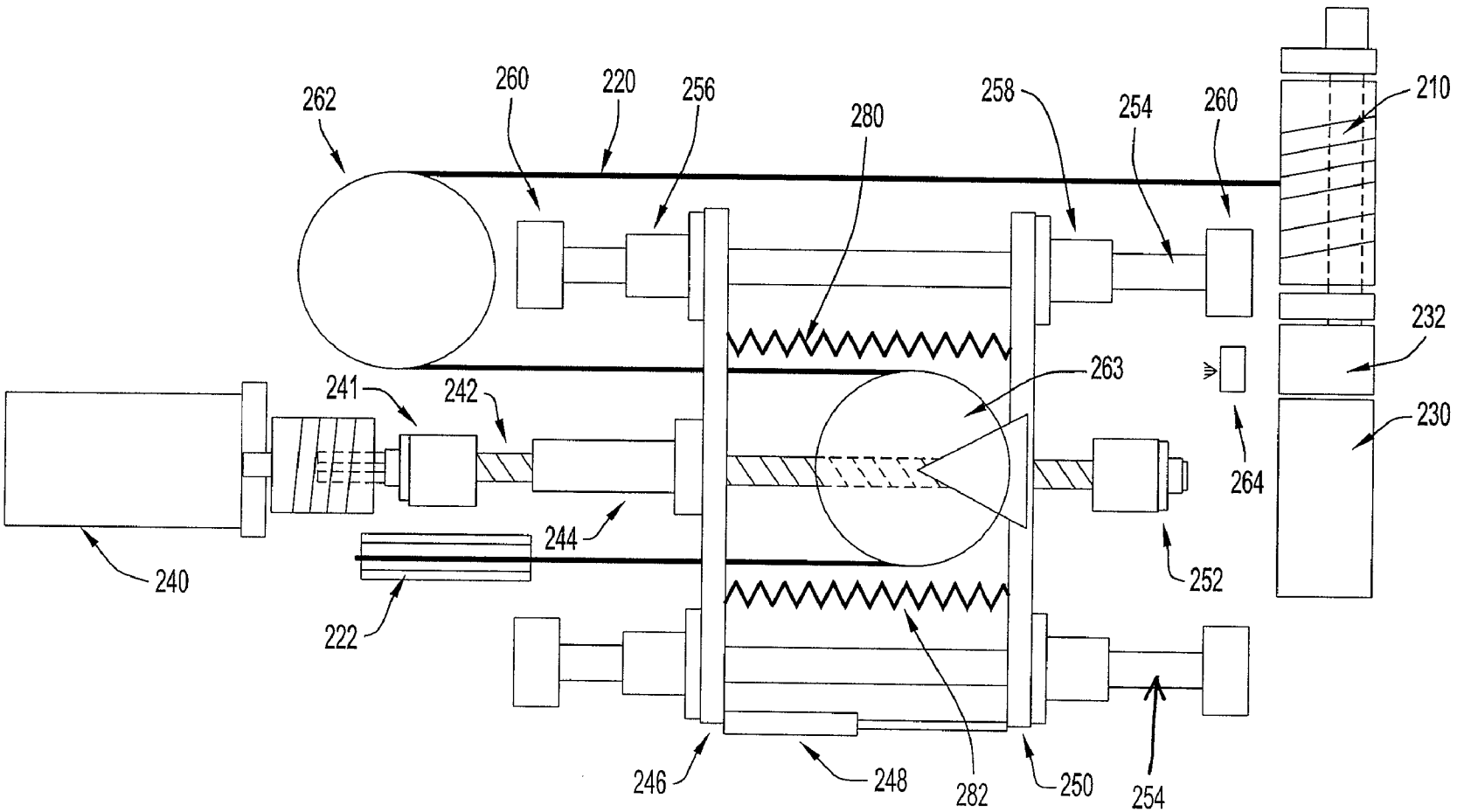
FIG. 20A is a schematic view of some of the unloading system components according to the present invention.

Referring to FIG. 20A, in this embodiment, the unloading system 200 includes two 16 inch hardened steel rods 254 spaced approximately eight inches apart in parallel, which are mounted to an aluminum plate supported by end blocks 260. Precision bearings 256 and 258 that are pressed into two plates, the pulley plate 250 and the ball-screw plate 246, allow the plates 246 and 250 to slide freely along the hardened rods 254. The pulley plate 250 has a 3.5 inch pulley 263 mounted to it which the unloading rope 220 is wound around.

The ball-screw motor 240 is coupled directly to a ball-screw 242, which has a ball-screw support block 241 and 252 mounted on either end. A ball-screw nut 244 is rigidly connected to the ball-screw plate 246. Two heavy-duty springs 280 and 282 reside between the two plates 246 and 250. A linear encoder 248 is mounted onto the ball-screw plate 246 and it measures the length of the springs 280 and 282. In this embodiment, an ultrasonic distance sensor 264 measures the distance between the pulley plate 250 and the rod support blocks 260. In one embodiment, a portion of the linear encoder 248 is mounted on the ball-screw plate 246 and another portion of the linear encoder 248 is mounted on the pulley plate 250.

Figure 21:
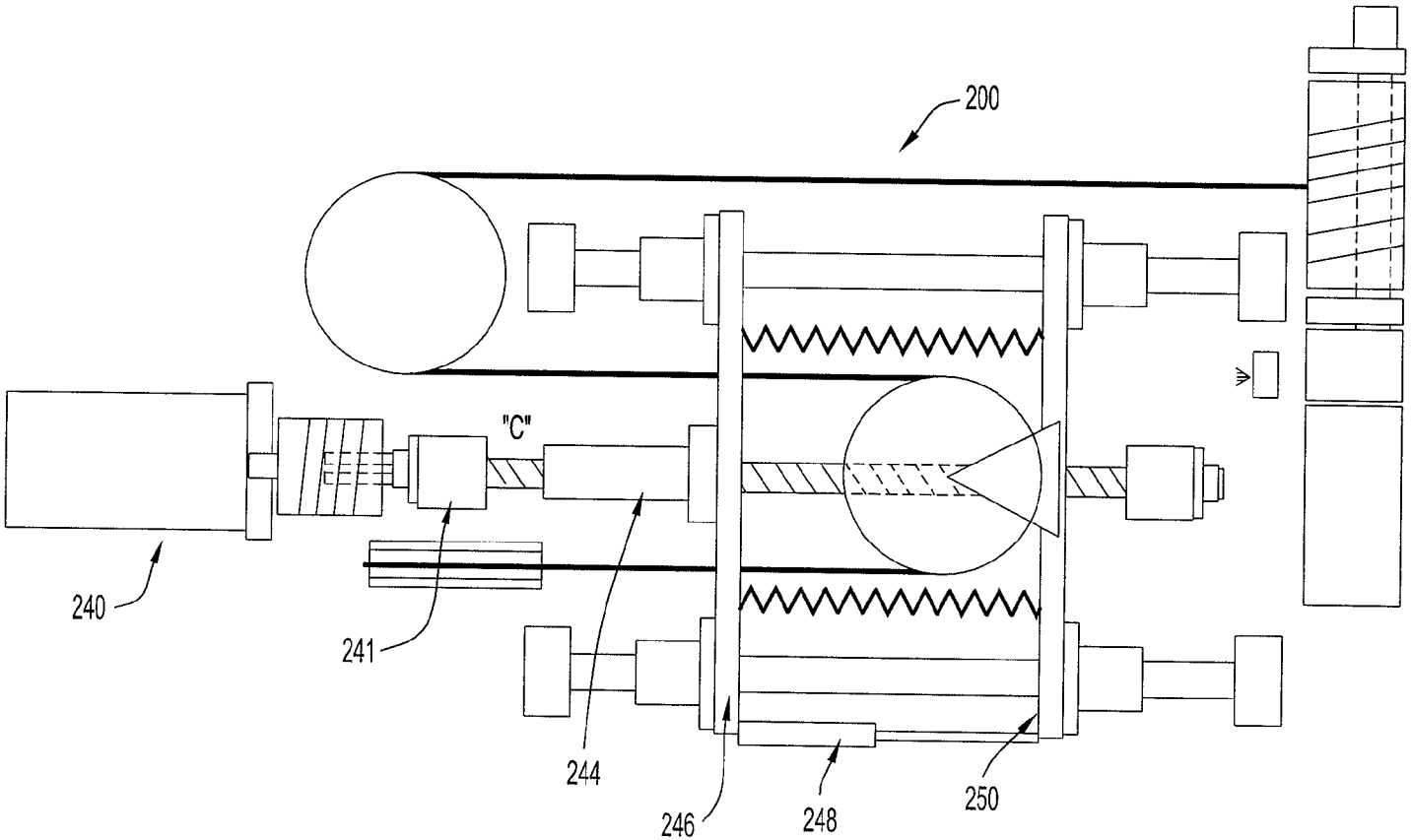
FIGS. 21-24 are schematic views illustrating the operation of the body-weight support system according to the present invention.

In the static state, the rope 220 comes off the winch drum 210, wraps around the fixed re-director pulley 262, around the pulley-plate pulley 263, over the drop-down pulley 222 and then down to the subject (see FIGS. 20A and 21). To apply tension in the rope 220, the ball-screw motor 240 turns the ball-screw 242 which in turn causes the ball-screw nut 244 to advance the ball-screw plate 246 toward the pulley plate 250. As a result, this movement causes the springs 280 and 282 to compress, causing a force against the pulley plate 250: $F=k*dx$ (see FIG. 22).

The ball-screw plate 246 moves at a slow and constant velocity towards the pulley plate 250, compressing the springs 280 and 282 at a constant rate. The controller running on the computer monitors the tension in the rope 220 using a single-axis force sensor so that the springs 280 and 282 are compressed until the desired magnitude of unloading force is achieved. In one embodiment, the maximum rope tension is 150 lbs. In other embodiments, rope having different properties can be used.

As the subject walks, the pulley plate 246 will move back and forth. In order to maintain the force in the rope 220 constant, the spring deflection, dx, must remain constant. The linear encoder 248 measures the instantaneous length of the springs 280 and 282 and if the dimension "dx" varies, the ball-screw motor 240 turns on and moves the ball-screw plate 246 to the left or to the right in order to maintain the spring deflection (dx) at the desired level of compression (see FIGS. 23 and 24). The pulley plate 250 moves back and forth along the direction of arrow "A" in FIG. 24 as the subject walks. The force sensor is also monitored continuously so that if the average rope force is too low, the springs 280 and 282 are compressed, or if the force is too high, the springs 280 and 282 are uncompressed.

In the event that a subject traverses obstacles such as ramps or stairs, the pulley plate 250 may move a significant amount. The ultrasonic sensor measures the location of the pulley plate 250 with respect to the rod support blocks 260. If either the ball-screw plate 246 or the pulley plate 250 moves too close to the rod support blocks 260, the winch motor 230 will turn on and either let rope 220 out (in the case when the ball-screw plate 246 is too close to the rod support blocks 260 shown on the left ends of rods 254 in FIG. 20A) or spool the rope 220 up (in the case when the pulley plate 250 is too close to the rod support blocks 260 shown on the right ends of rods 254 in FIG. 20A). During this time, the linear encoder 248 continues to measure the spring length and causes the ball-screw motor 240 to be activated if the desired amount of spring compression varies.

Figure 22:
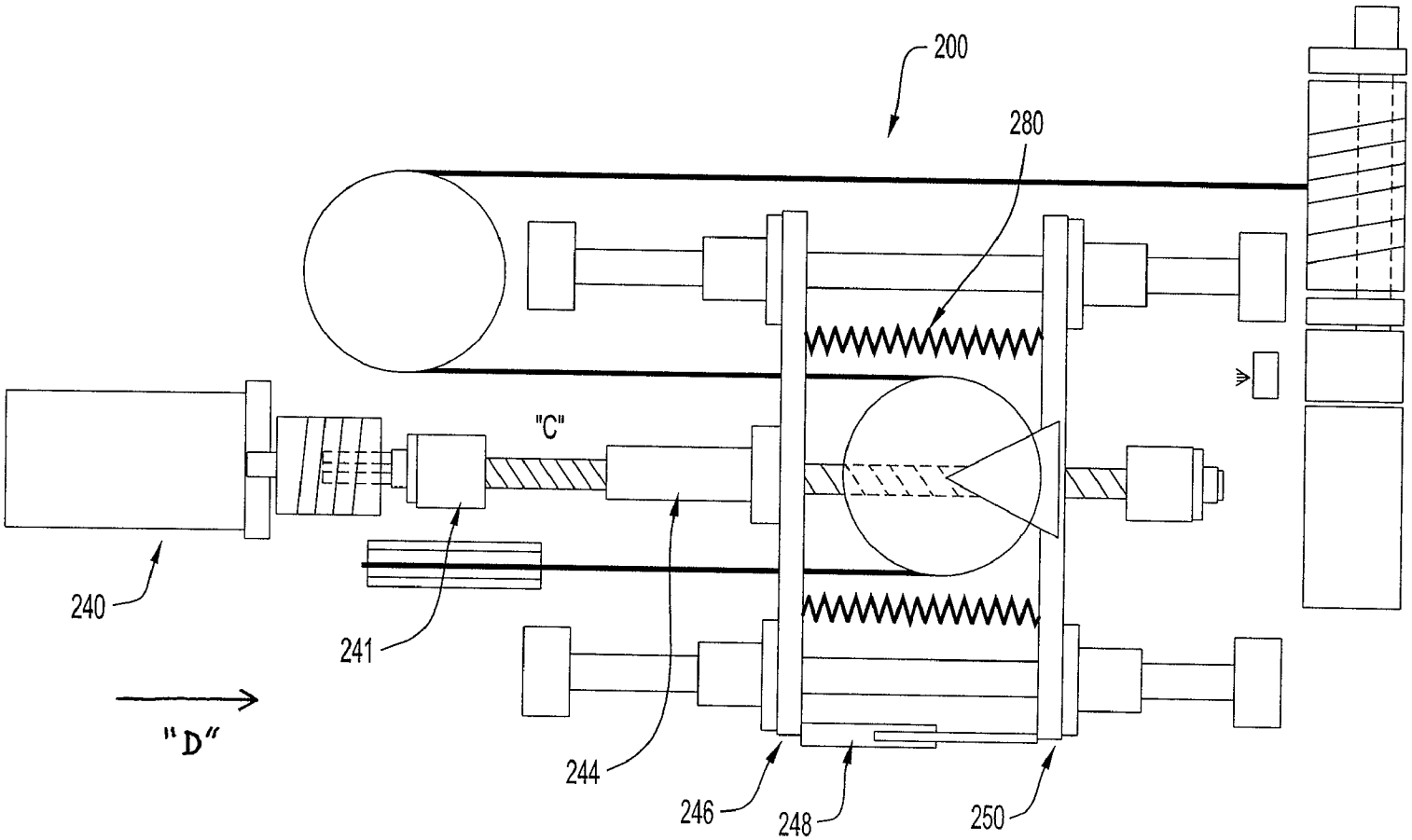

Referring to FIG. 21, the distance between the ball-screw support block 241 and the ball-screw nut 244 is illustrated as "C." In FIG. 22, the ball-screw motor 240 is activated to move the ball-screw plate 246 along the direction of arrow "D." As a result, the distance "C" between the support block 241 and the ball-screw nut 244 increases. Similarly, the distance between the ball-screw plate 246 and the rod support blocks 260 increases.

Figure 23:
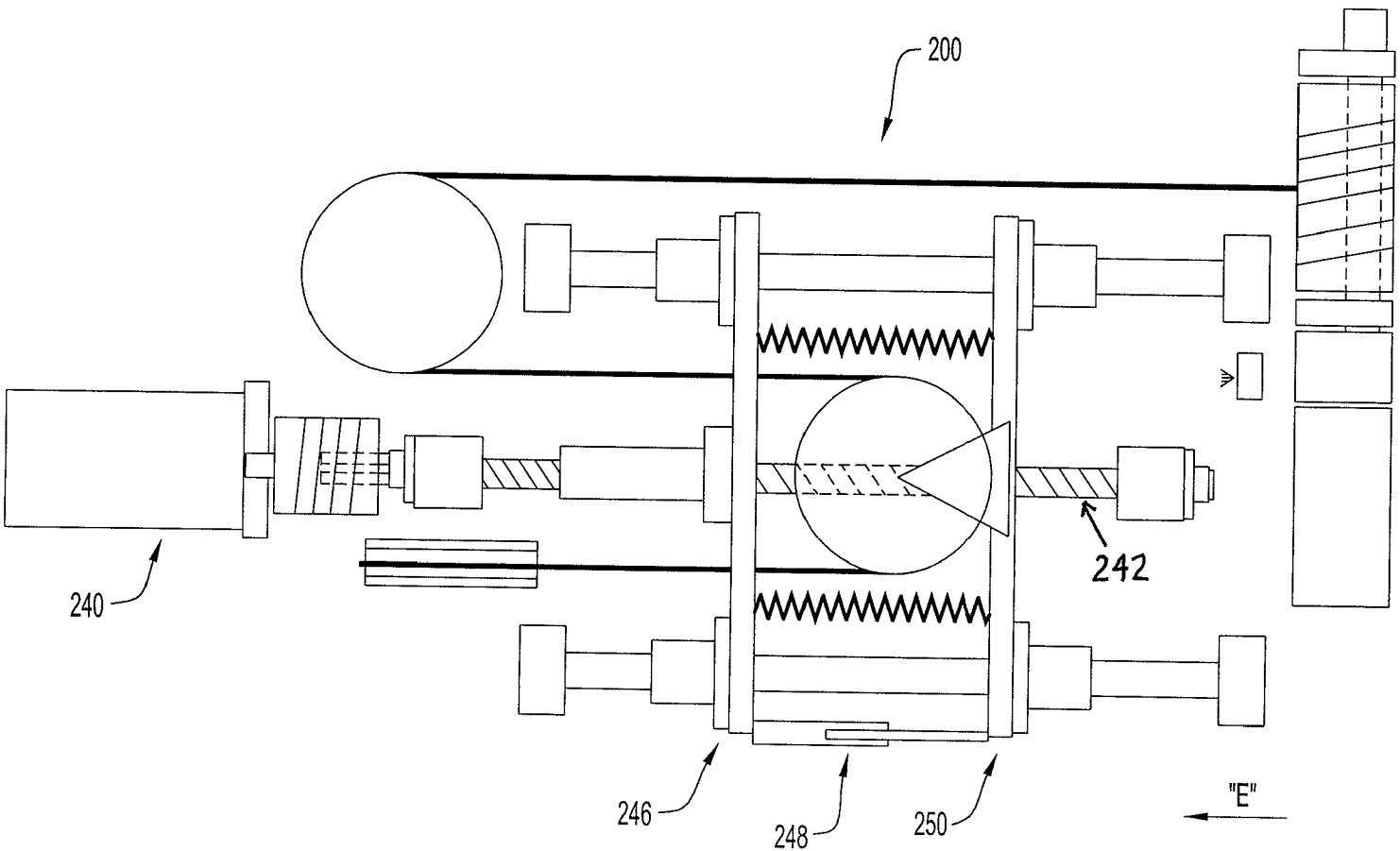
Figure 24:
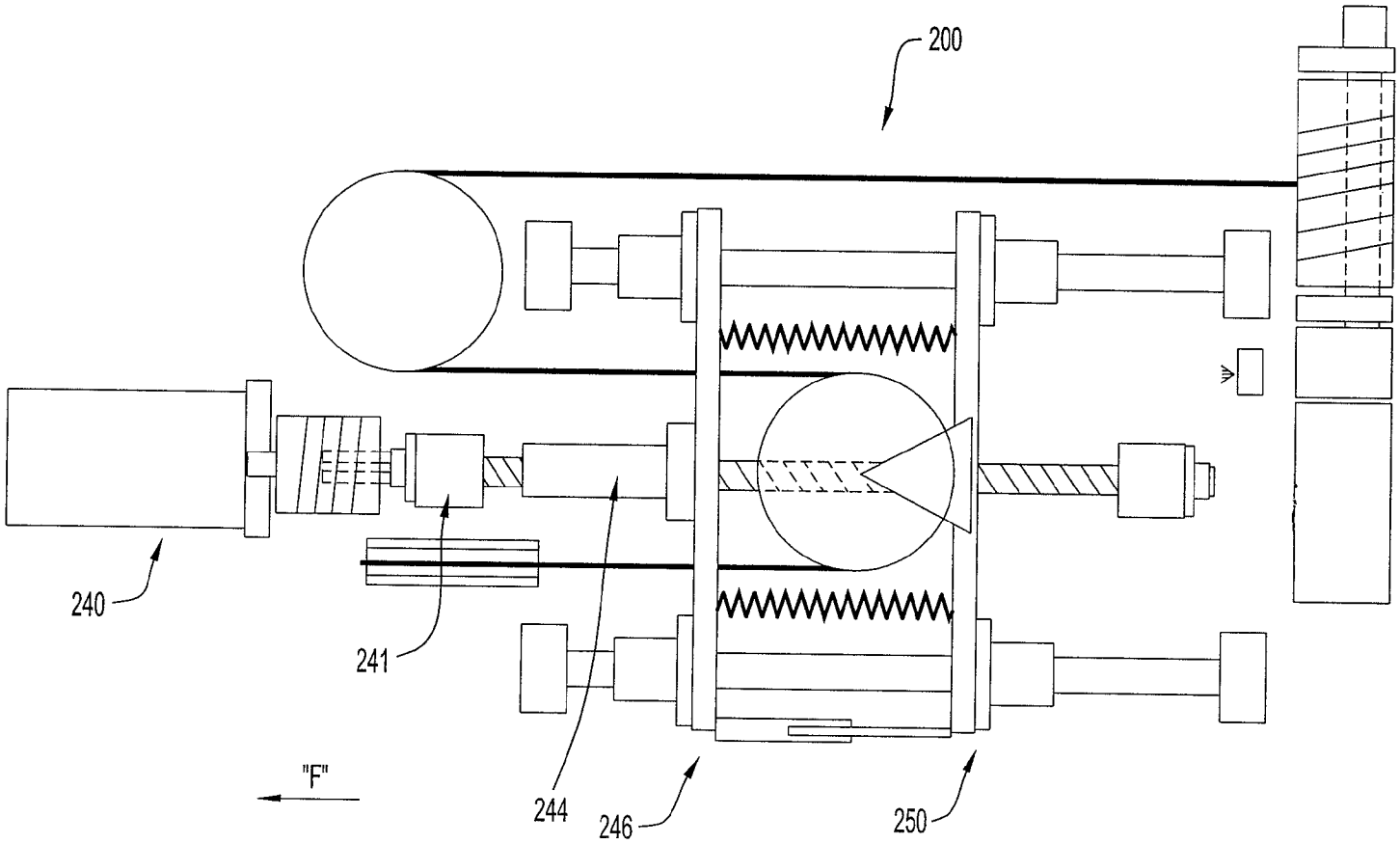

Referring to FIG. 23, the ball-screw motor 240 has been activated and the ball-screw plate 246 and the pulley plate 250 are moved along the direction of arrow "E." As a result, the length of the rope 220 extending downwardly from the support system 200 increases, thereby lowering the spreader bar 302. Referring to FIG. 24, the ball-screw motor 240 is further activated and the ball-screw plate 246 and the pulley plate 250 are moved along the direction of arrow "F."

Figure 20B:
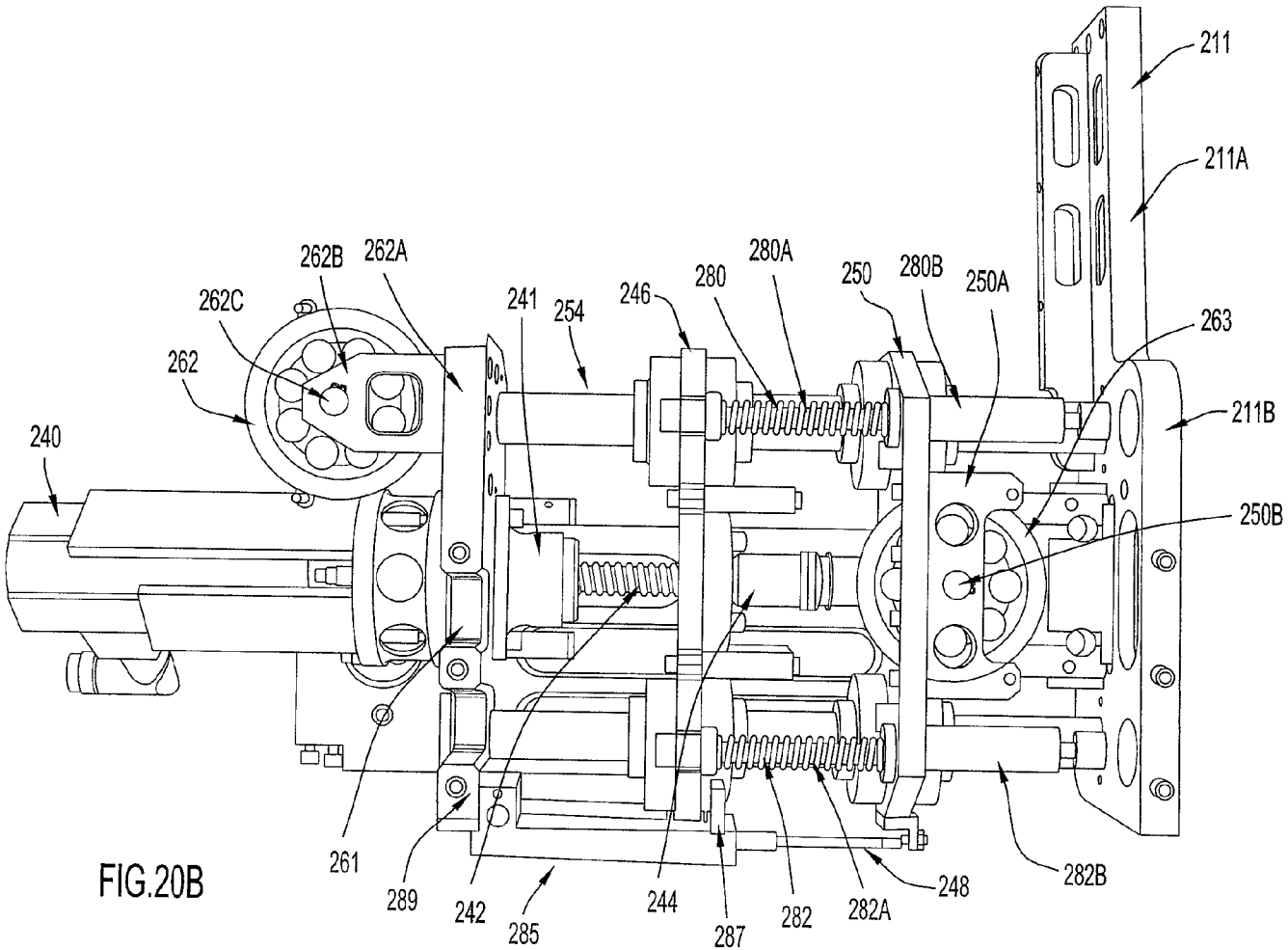
FIG. 20B is a top view of an alternative embodiment of an unloading system according to the present invention.

Referring to FIG. 20B, an alternative embodiment of an unloading system according to the present invention is illustrated. Some of the components in the unloading system illustrated in FIG. 20B are similar to components in the unloading system illustrated in FIGS. 20A and 21-24. Accordingly, like reference numerals are used to designate like components.

As illustrated, the ball-screw drive 240 is supported on a base plate 261 and is configured to rotate the ball-screw 242. The ball-screw 242 extends from support block 241 and moves ball-screw nut 244 as it rotates. Movement of the ball-screw nut 244 along the ball-screw 242 causes movement of the ball-screw plate 246. As shown, spring 280 is mounted between plates 246 and 250. Spring 280 is mounted on a rod 280A that extends therethrough and that provides lateral stability to the spring 280. Rod 280A is coupled to rod 280B. Similarly, spring 282 is mounted on a rod 282A that extends therethrough and that provides lateral stability to the spring 282. Rod 282A is coupled to rod 282B. Linear encoder 248, which detects the distance between plates 246 and 250, is illustrated as well.

In this embodiment, the base plate 261 includes a mounting portion 262A to which a pair of supports 262B is coupled (only one support 262B is shown in FIG. 20B). Pulley 262, described above, is rotatably mounted on an axle 262C that has ends that are mounted in an opening in each of the supports 262B.

Referring to FIG. 20B, the pulley plate 250 includes a pair of supports 250A coupled thereto (only one support 250A is shown in FIG. 20B). Each of the supports 250A includes a hole or opening in which an end of an axle 250B is inserted. Pulley 263 is rotatably mounted on the axle 250B. The unloading system also includes a mounting plate 211 with a mounting portion 211A to which the winch drum 210 is rotatably mounted. The mounting plate 211 also includes a portion 211B to which ends of the support rods 254 are coupled.

In this embodiment, the unloading system includes a sensor 285 that measures the distance between the base plate 261 and the ball-screw plate 246, which in turn allows for the positions of the ball-screw plate 246 and the pulley plate 250 to be calculated and determined. In one implementation, the sensor 285 is an ultrasonic sensor that includes an emitter 289 and a reflecting plate 287. The emitter 289 is coupled or mounted to the base plate 261. The reflecting plate 287 is coupled or mounted to the ball-screw plate 246. Once the positions of the emitter 289 and the reflecting plate 287 are calibrated with the control system, the sensor 285 can determine the position of the ball-screw plate 246 and in turn, the pulley plate 250. In other embodiments, the sensor 285 can have a different structure or utilize different components.

In normal operation, the springs 280 and 282 compress and the ball-screw plate 246 and the pulley plate 250 move back and forth as a unit. If the lengths of the springs 280 and 282 remain constant, the force on the springs does as well. The ball-screw plate 246 and the pulley plate 250 can move back and forth in the area between the base plate 261 and the mounting plate 211, as shown in FIG. 20B. For a large change in vertical excursion, such as when a subject steps off a stair or stands up, plates 246 and 250 can rapidly approach one end of the area between base plate 261 and mounting plate 211. When the plates 246 and 250 engage one end of the area, the plates 246 and 250 can bottom out and be difficult to move. The control system includes an algorithm that is used to center the ball-screw plate 246 and the pulley plate 250 in the middle region along the rails or support rods 254 and away from the ends of the rods 254. If one of the plates 246 and 250 runs into an end, the ball-screw motor 242 cannot adjust the spring length appropriately and the force on the rope 220 changes. By controlling the position of the ball-screw plate 246 and the pulley plate 250, the unloading system allows for large changes in vertical position of the subject while simultaneously keeping the force on the system and the rope 220 constant.

Accordingly, the sensor 285 monitors where the two-plate unit (including the ball-screw plate 246 and the pulley plate 250) is located along the support rods or rails 254. If the ball-screw plate 246 and the pulley plate 250 move too close to one end of the travel area, the controller turns on the winch motor 230 which causes the winch 210 to rotate. In the case where the subject moves downwardly quickly, the two-plate unit can move too close to the end of the area proximate to the base plate 261. In this scenario, the winch motor 230 causes the winch 210 to rotate in the direction in which rope 220 is let out from the winch 210 and around pulley 263. Movement of the rope 220 in that direction permits the ball-screw plate 246 and the pulley plate 250 to be re-centered in the area between base plate 261 and mounting plate 211. At the same time as the activation of the winch motor 230, the ball-screw motor 242 is activated to maintain the length of the springs 280 and 282 constant, which in turn keeps the force being unloaded by the unloading system constant.

In the case where the subject moves upwardly quickly, the two-plate unit moves too close to the end of the area proximate to the mounting plate 211. In this scenario, the winch motor 230 causes the winch 210 to rotate in the direction in which rope 220 is pulled up toward the trolley and wound onto the winch 210. Movement of the rope 220 in that direction permits the ball-screw plate 246 and the pulley plate 250 to be re-centered in the area between base plate 261 and mounting plate 211. At the same time as the activation of the winch motor 230, the ball-screw motor 242 is activated to maintain the length of the springs 280 and 282 constant, which in turn keeps the force being unloaded by the unloading system constant.

Figure 25:
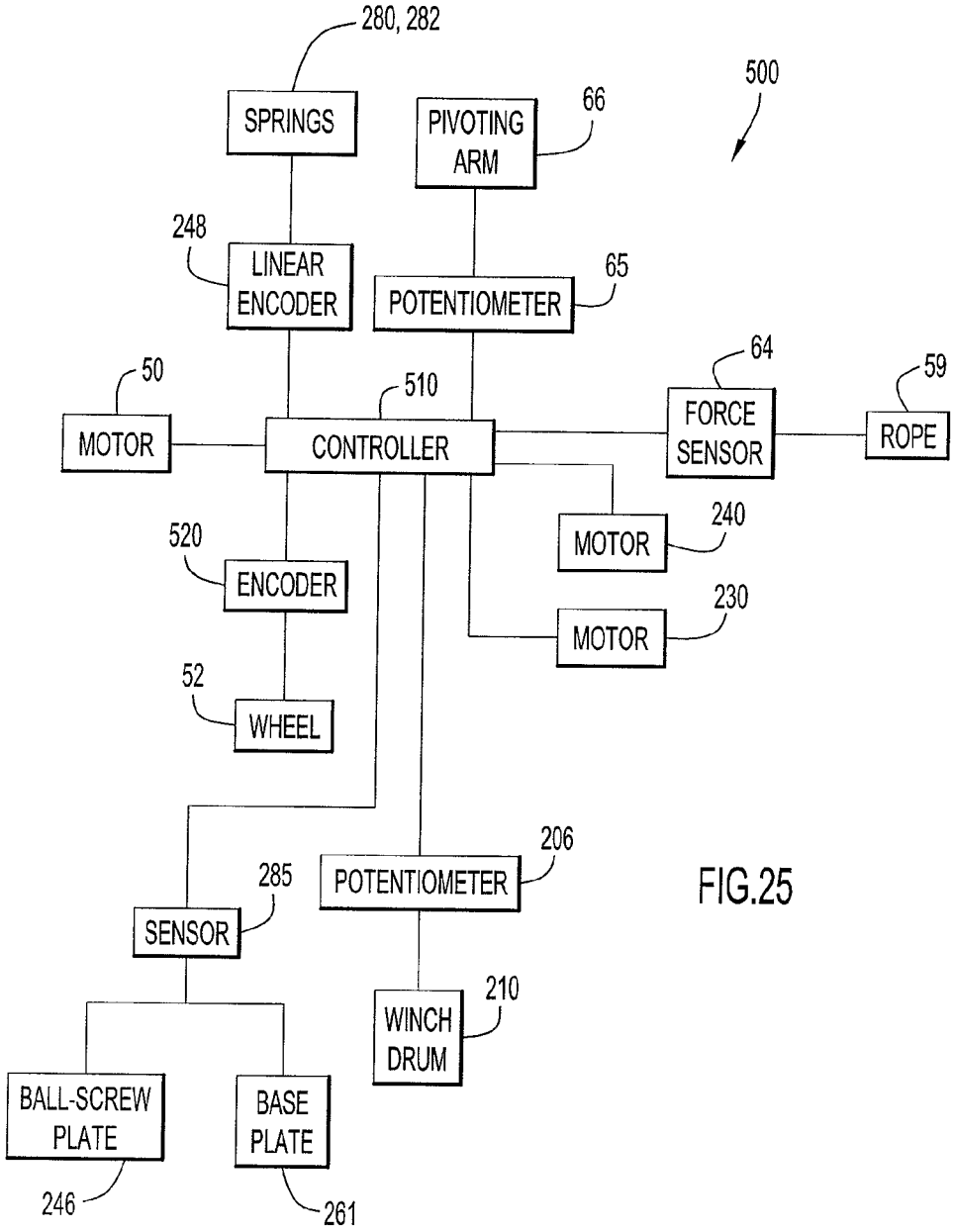
FIG. 25 is a schematic block diagram of an embodiment of a control system of a body-weight support system according to the present invention.

The system described above is controlled via a standard computer, such as a personal computer or PC, that contains data acquisition cards which acquire data from the system's sensors. An exemplary embodiment of a control system is illustrated in FIG. 25. In this embodiment, the control system 500 includes a controller 510 that is configured to receive various inputs from the sensors or detectors of the system. Some exemplary sensors on the device include an linear encoder 248 which measures the spring length of the springs 280 and 282, a free-wheel encoder 520 which measures the movement of the trolley 30 along the rail 40, a multi-turn potentiometer 206 which measures the winch drum 210 position, a precision potentiometer 65 which measure the pivoting arm angle 67 (for the trolley controller) of arm 66, and a single-axis force sensor 64 which measures the tension in the rope 220. Finally, the control system also includes sensor 285 that is configured to determine the distance between the ball-screw plate 246 and the base plate 261. In one embodiment, all of these sensors are in communication with the controller or a computer through data acquisition boards and are sampled a high rates (e.g. 1000 Hz). The system 500 includes the drive motor 50, the winch motor 230, and the ball-screw motor 240. Each of the motors 50, 230, and 240 is controlled based on the inputs from the corresponding sensors.

Figure 26:
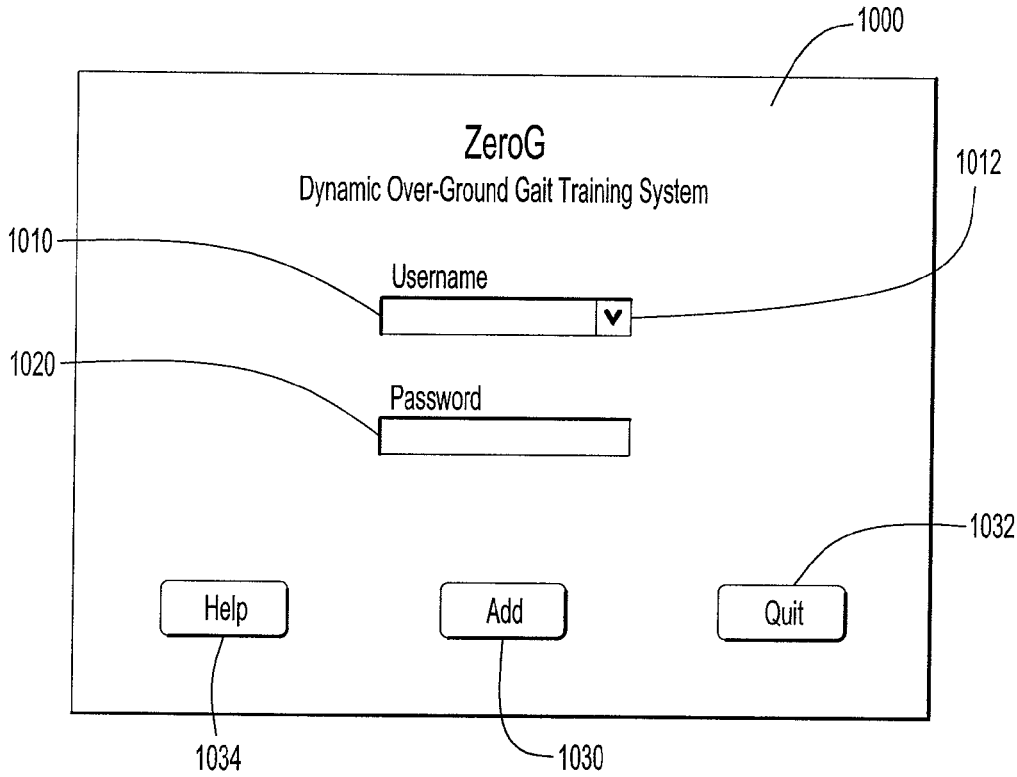
FIGS. 26-38 are exemplary user interfaces that can be used with the body-weight system according to the present invention.
Figure 27:
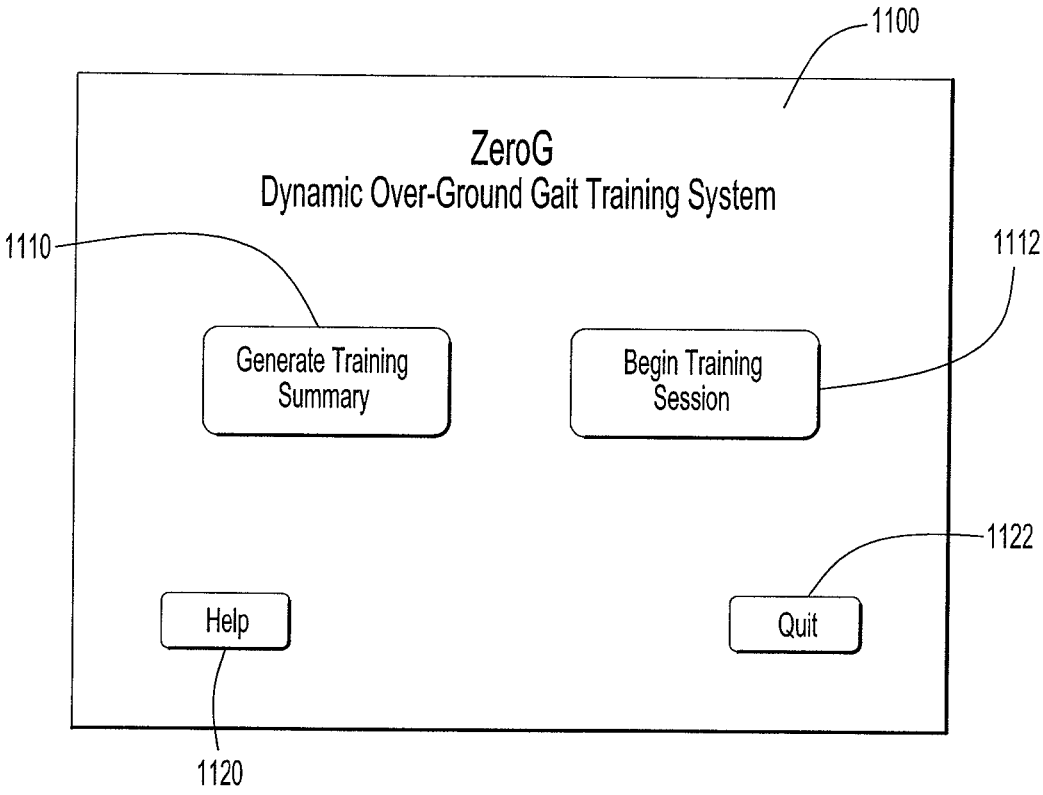

As mentioned above, the body-weight support system according to the present invention can be used with a graphical user interface. One exemplary interface system is illustrated in FIGS. 26-37. While FIGS. 26-27 illustrate various screens that can be used with the system, it is to be understood that the screens may have any configuration and may include different features or components than those illustrated herein. The buttons on the interfaces can be referred to alternatively as inputs or input mechanisms.

Referring to FIG. 26, an initial screenshot or interface is illustrated. Interface 1000 is an introductory screen in which a therapist or other caregiver enters or logs on to the system. An entry field 1010 in which the therapist enters his or her name is provided along with a corresponding drop down arrow 1012 that can be selected to access pre-entered information, such as various names. An entry field 1020 is provided in which the user can enter a password. Several buttons are provided for additional inputs by a user. An "Add" button 1030 can be selected to add a new user to the database of users. A "Quit" button 1032 can be selected to end the entering or logging on process. A "Help" button 1034 can be selected when assistance is needed or desired.

Referring to FIG. 27, another interface or screen 1100 is illustrated. Interface 1100 includes a "Generate Training Summary" button 1110 that can be selected by a user to cause the computer system to generate an output based on the detected data. For example, when a user selects button 1110, an output in the form of a graph, such as the graph illustrated in FIG. 38, can be generated. Alternatively, when a user selects button 1110, an interface such as interface 1900 can be displayed and subsequently used as described below. Interface 1100 also includes a "Begin Training Session" button 1112 that can be selected by a user to start a new training session for a subject. If button 1112 is selected, the next user interface can be similar to interface 1120 illustrated in FIG. 28. Referring back to FIG. 27, a "Help" button 1120 and a "Quit" button 1122 can be provided as well.

Figure 28:
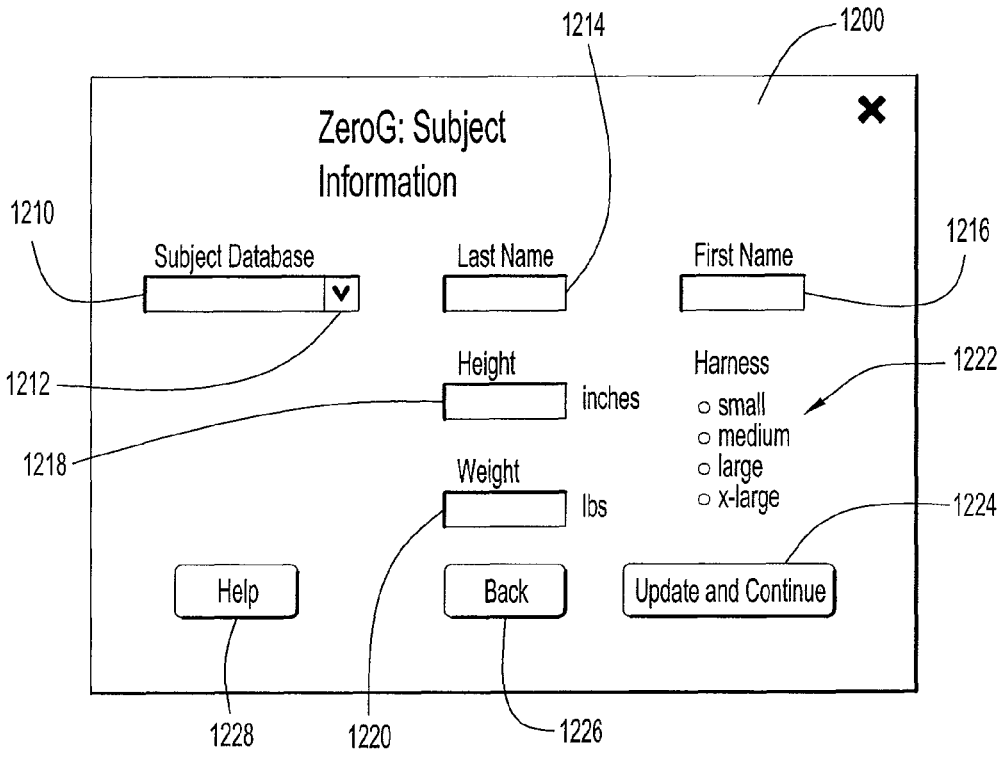

Referring to FIG. 28, a exemplary interface for the start of a new training session is illustrated. Interface 1200 includes an entry field 1210 and associated drop-down arrow 1212 that allows a user to enter a new database or select an existing database. Interface 1200 includes entry fields for the subject's "Last Name" (see field 1214), "First Name" (see field 1216), "Height" (see field 1218), and "Weight" (see field 1220). Interface 1200 also includes a harness selection area 1222 which sets forth various sizes of harnesses and enables a user to select therefrom. When the foregoing information has been entered by a user, the "Update and Continue" button 1224 can be selected by a user. Interface 1200 also includes a "Back"

button 1226 and a "Help" button 1228. In different embodiments, additional or alternative fields can be provided in interface 1200 in which other information relating to the subject can be entered.

Figure 29:
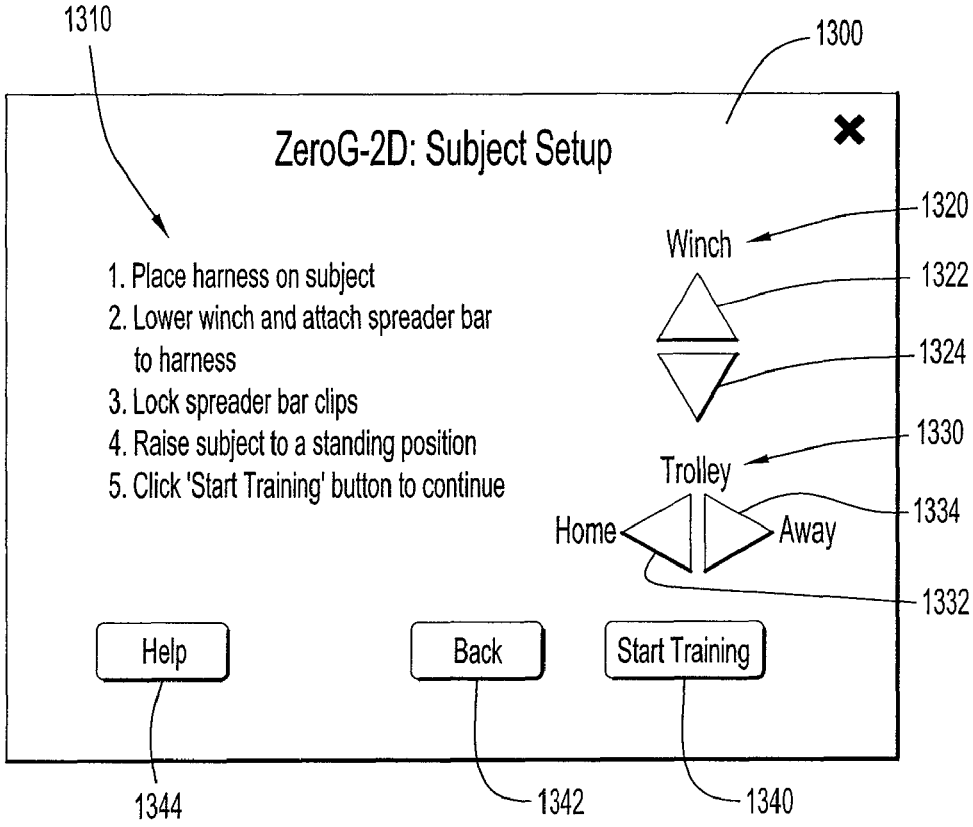

Referring to FIG. 29, an interface or screen associated with the setting up of a subject is illustrated. In this embodiment, the interface 1300 includes an instruction section 1310 that sets forth the various steps. Interface 1300 includes a Winch section 1320 that includes an up button 1322 and a down button 1324. The user can raise or lower the spreader bar 302 by way of selecting the corresponding up button 1322 or down button 1324 that controls the movement of the winch 210. Similarly, the interface 1300 includes a Trolley section 1330 that includes a home button 1332 and an away button 1334 that can be selected by the user to move the trolley in the desired direction. Once the winch 210 and the trolley 30 have been moved to their desired positions, the user can select the "Start Training" button 1340. Interface 1300 also includes a "Back" button 1342 and a "Help" button 1344.

Figure 30:
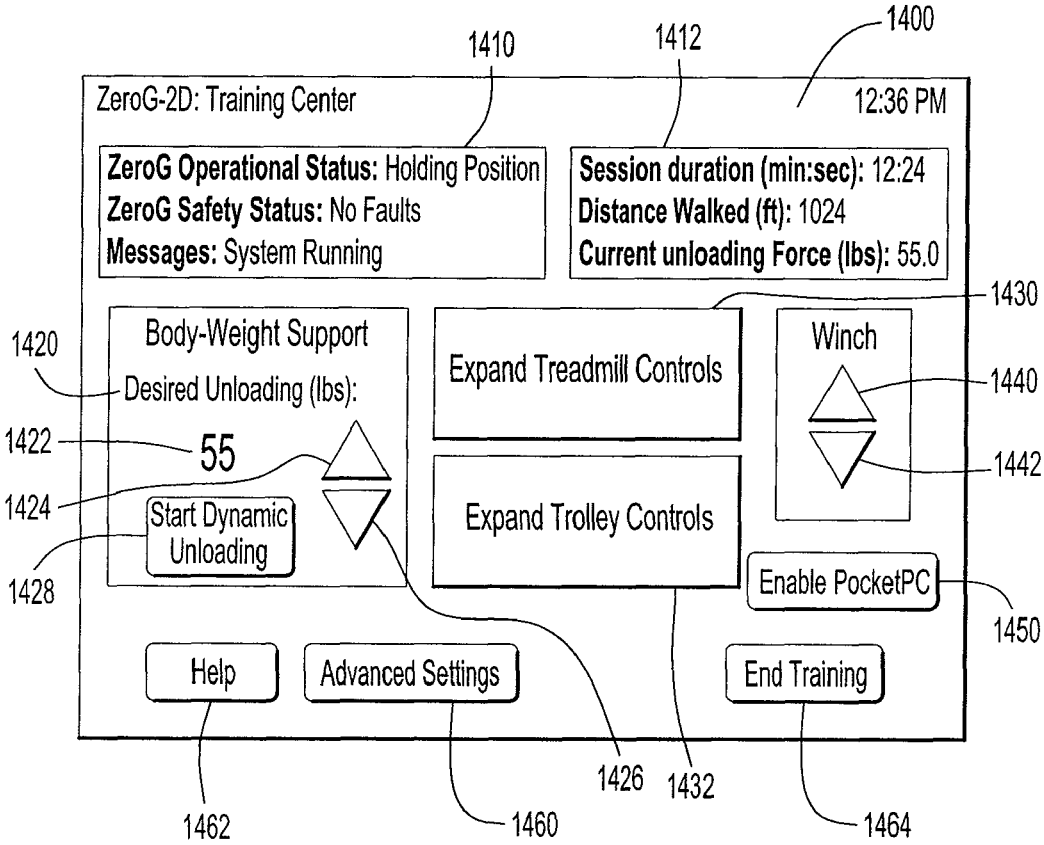

Referring to FIG. 30, an exemplary interface of a training center is illustrated. In this embodiment, the interface 1400 includes two informational sections 1410 and 1412 that provide information relating to the current training session. In other embodiments, the informational sections 1410 and 1412 can include different information than that shown in FIG. 30. Interface 1400 includes a body-weight support portion 1420 in which the desired unloading can be selected. The particular unloading amount in the unit of lbs is indicated by indicia 1422, which in this example is 55 lbs. In other embodiments, the units can be changed to kilograms or other unit of measure. Up and down buttons 1424 and 1426 respectively can be selected by the user to change the desired unloading as indicated by indicia 1422 accordingly. Once the desired unloading amount is correct, the user can select the "Start Dynamic Unloading" button 1428. Interface 1400 includes other inputs or buttons that the user can select. As shown in FIG. 30, a button 1430 entitled "Expand Treadmill Controls" is provided that enables a user to see a more detailed view of the controls for the treadmill feature of the system (see interface 1500 illustrated in FIG. 31 for example, which is described below). In addition, interface 1400 includes a button 1432 entitled "Expand Trolley Controls" which enables a user to see a more detailed view of the controls of the trolley of the system (see interfaces 1600 and 1700 illustrated in FIGS. 32 and 33 for example, which is described below).

Referring back to FIG. 30, a Winch control section with an up button 1440 and a down button 1442 is provided. In addition, a button 1450 entitled "Enable PocketPC" is provided which allows a user to activate a wireless device, such as a handheld device, to operate the system therewith. Interface 1400 also includes an "Advanced Settings" button 1460, a "Help" button 1462, and an "End Training" button 1464.

Figure 31:
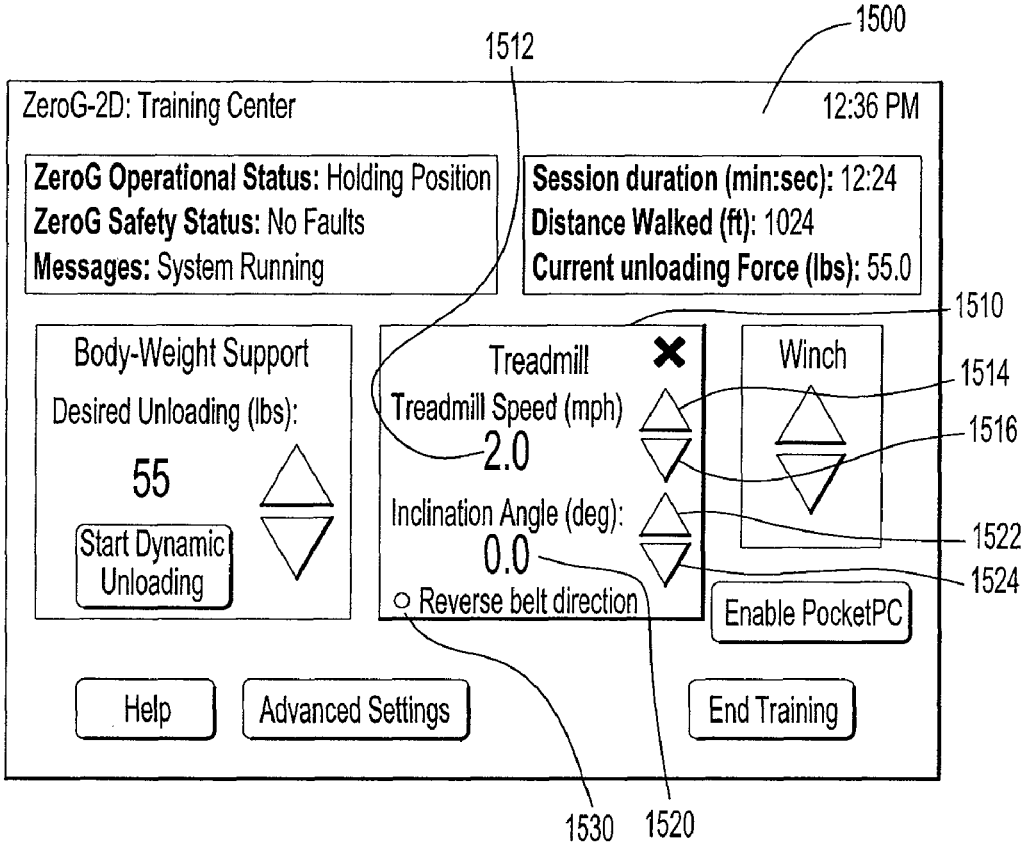

Referring to FIG. 31, an interface 1500 that has expanded Treadmill controls is illustrated. Interface 1500 is an exemplary interface that may be used with the system when a user selects the "Expand Treadmill Controls" button 1430 in interface 1400. For simplicity of the description, only the differences between interface 1500 and interface 1400 are described with respect to FIG. 31.

Interface 1500 includes a treadmill control section 1510 with an indicator or indicia 1512 that illustrates the current speed of the treadmill with which the body-weight support system is being used. While indicator 1512 is illustrated in units of mph, alternative units such as kilometers per hour may be in alternative systems. Up and down buttons 1514 and 1516, respectively, can be selected by a user to vary the treadmill speed as desired. In addition, the angle of inclination of the treadmill is shown by indicator 1520 in units of degrees. Buttons 1522 and 1524 can be selected by the user to increase or decrease the angle of inclination as desired. A user input 1530 for reversing the direction of the travel of the belt of the treadmill is also provided.

Figure 32:
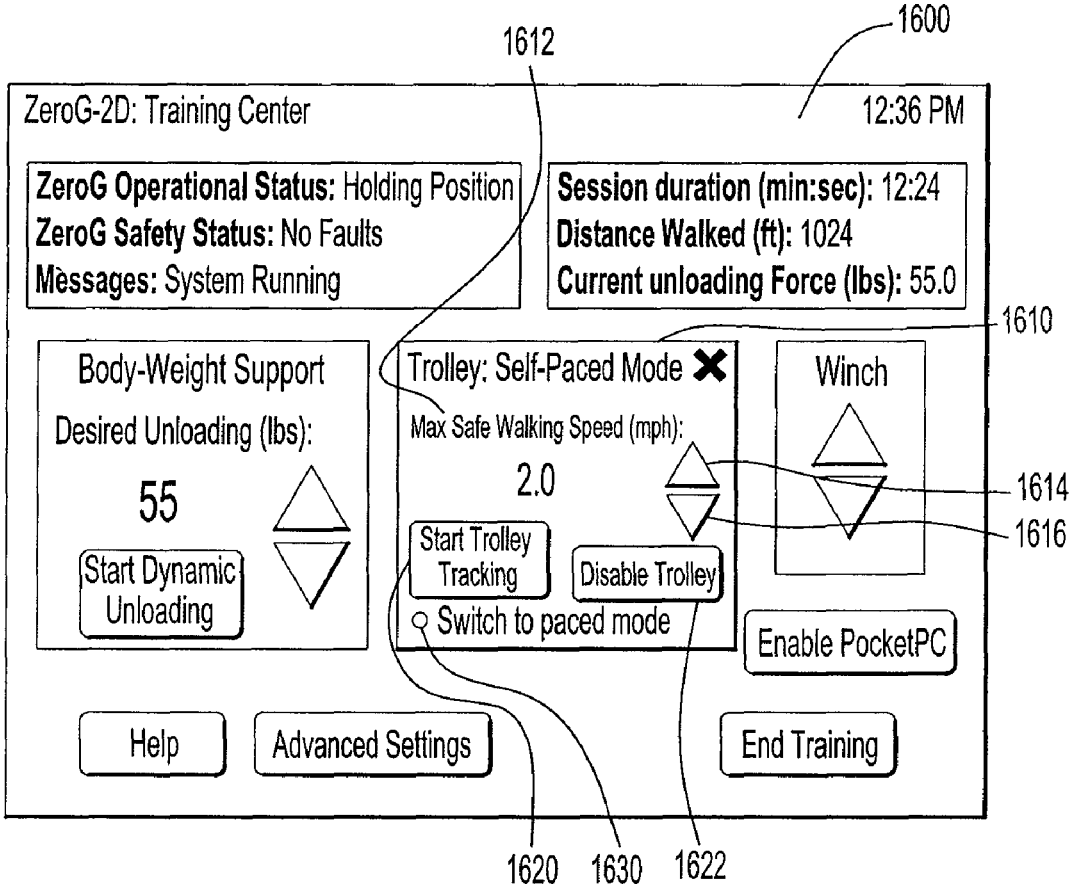

Referring to FIG. 32, an interface 1600 that has expanded Trolley controls is illustrated. Interface 1600 is an exemplary interface that may be used with the system when a user selects the "Expand Trolley Controls" button 1432 in interface 1400. For simplicity of the description, only the differences between interface 1600 and interface 1400 are described with respect to FIG. 32.

Interface 1600 includes a trolley control section 1610 with an indicator or indicia 1612 that illustrates the current speed of the treadmill with which the body-weight support system is being used. While indicator 1612 is illustrated in units of mph, alternative units such as kilometers per hour may be in alternative systems. In this embodiment, the trolley is operating in a self-paced mode. Up and down buttons 1614 and 1616, respectively, can be selected by a user to vary the treadmill speed as desired. The trolley control section 1610 includes a "Start Trolley Tracking" button 1620 and a "Disable Trolley" button 1622. A user input 1630 for switching the mode of trolley control to a paced mode is also provided. The "X" in the top right corner of the trolley control section 1610 can be selected by a user to close the trolley control section 1610 and return to interface 1400.

Figure 33:
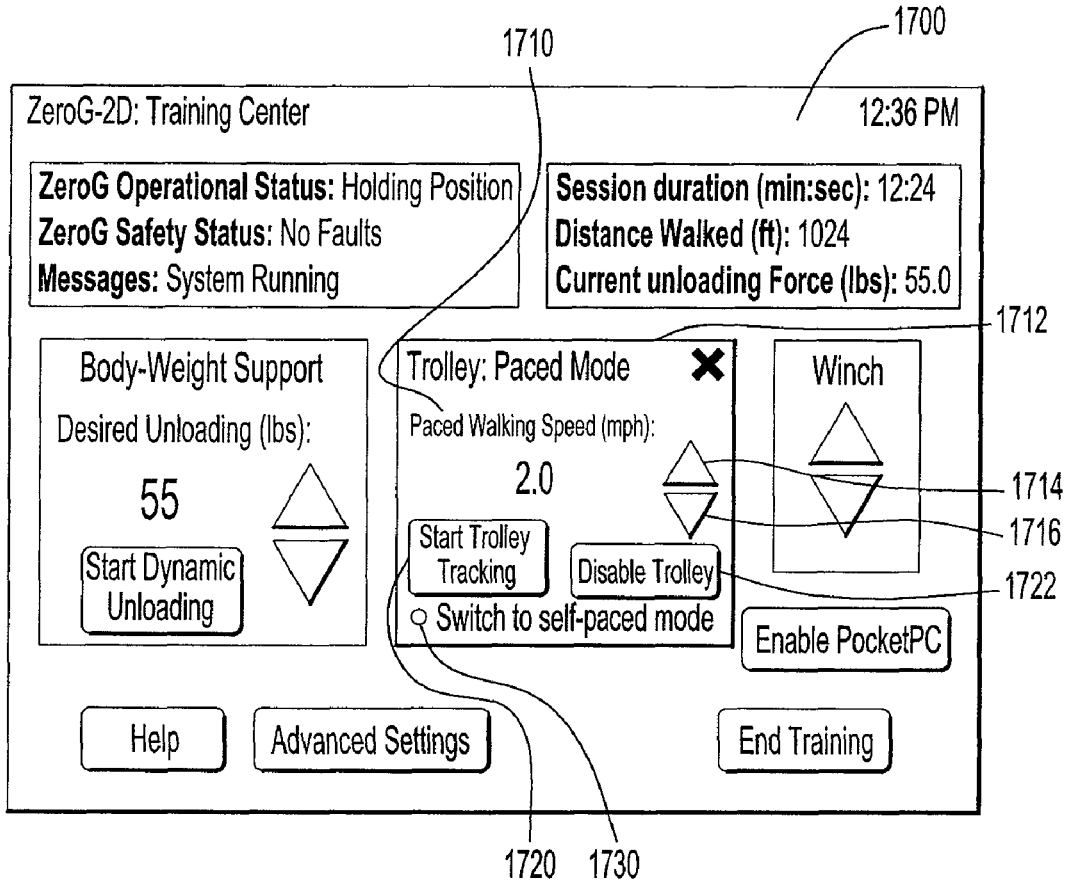

Referring to FIG. 33, an interface 1700 that has expanded Trolley controls different than the controls shown in interface 1600 is illustrated. Interface 1700 is an exemplary interface that may be used with the system when a user selects the "Expand Trolley Controls" button 1432 in interface 1400. For simplicity of the description, only the differences between interface 1700 and interface 1400 are described with respect to FIG. 33.

Interface 1700 includes a trolley control section 1710 with an indicator or indicia 1712 that illustrates the paced walking speed of the treadmill with which the body-weight support system is being used. While indicator 1712 is illustrated in units of mph, alternative units such as kilometers per hour may be in alternative systems. In this embodiment, the trolley is operating in a paced mode. Up and down buttons 1714 and 1716, respectively, can be selected by a user to vary the treadmill speed as desired. The trolley control section 1710 includes a "Start Trolley Tracking" button 1720 and a "Disable Trolley" button 1722. A user input 1730 for switching the mode of trolley control to a self-paced mode is also provided.

Figure 34:
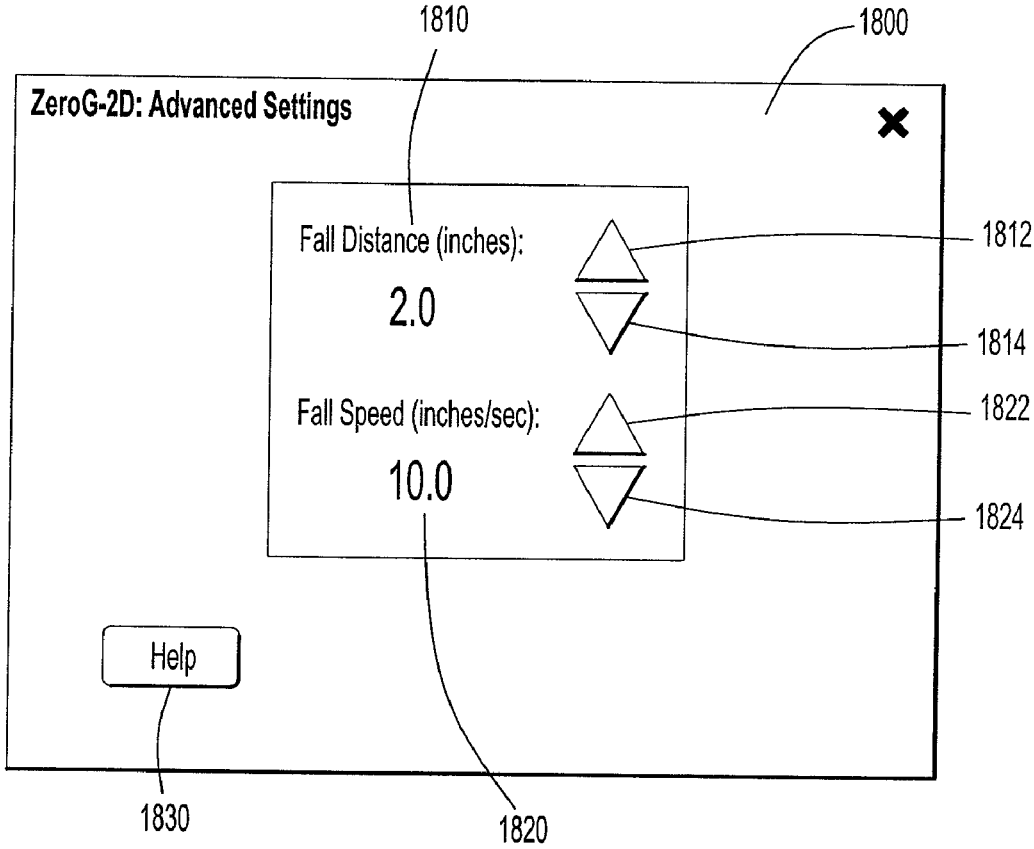

Referring to FIG. 34, an interface 1800 that sets forth "Advanced Settings" controls is illustrated. Interface 1800 is an exemplary interface that may be used with the system when a user selects the "Advanced Settings" button 1460 in interfaces 1400, 1500, 1600, or 1700.

Interface 1800 includes an indicator or indicia 1810 that identifies the selected fall distance limit for the subject using the body-weight support system. While the fall distance limit in indicator 1810 is identified in inches, alternative units such as centimeters may be in alternative systems. Interface 1800 includes buttons 1812 and 1814 that can be selected by a user to increase or decrease the fall distance as desired. Interface 1800 also includes a fall speed section with a fall speed indicator 1820 that identifies the desired fall speed of the patient. While the indicator 1820 is in units of inches per second, in other embodiments, the indicator 1820 can be in units of centimeters per second or other similar units. Interface 1800 includes buttons 1822 and 1824 that can be selected by a user to increase or decrease the fall speed as desired. A user input 1830 entitled "Help" can be provided as well.

Figure 35:
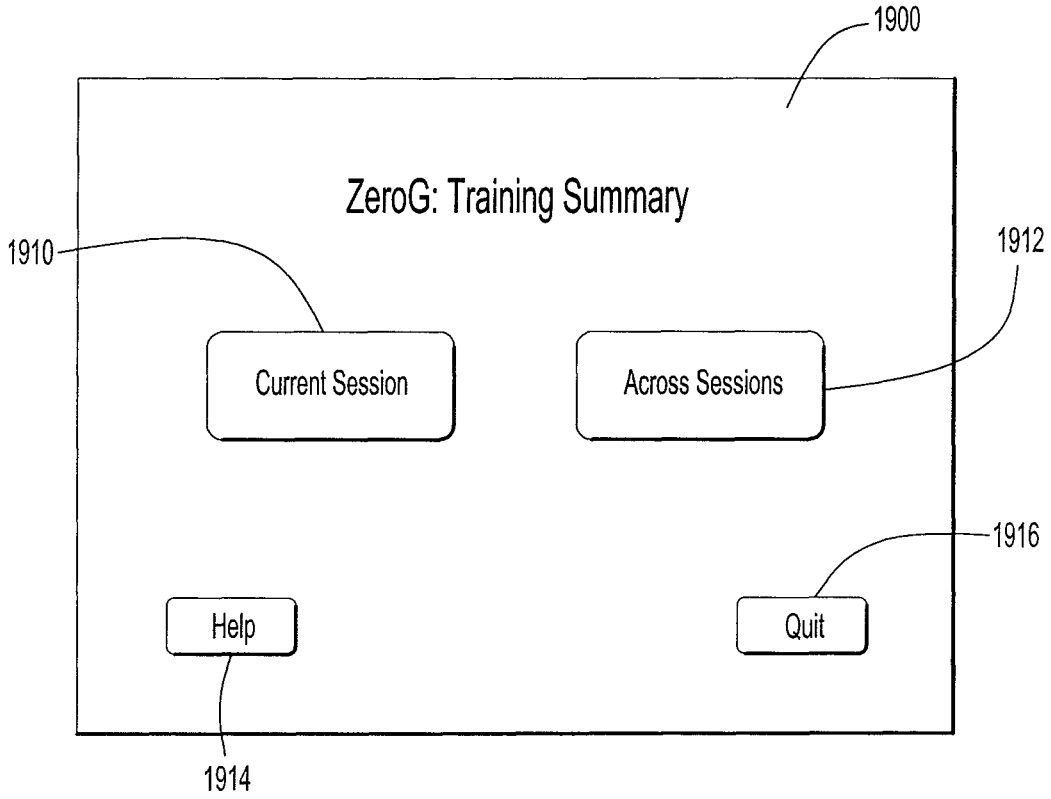

Referring to FIG. 35, an interface 1900 relating to training summaries is illustrated. Interface 1900 is an exemplary interface that may be used with the system when a user selects the "Generate Training Summary" button 1110 in interface 1100. In other embodiments, interface 1900 can be reached upon the selection of a different button or input mechanism or the natural progression of the program upon the completion of a training summary.

Interface 1900 includes a "Current Session" button 1910 and an "Across Sessions" button 1912 that can be selected by a user to identify the data and training session(s) that are to be the basis for the training summary to be generated. Activation of the "Across Sessions" button 1912 causes data from multiple training sessions to be used in the summary. Interface 1900 includes a "Help" button 1914 and a "Quit" button 1916 as well.

Figure 36:
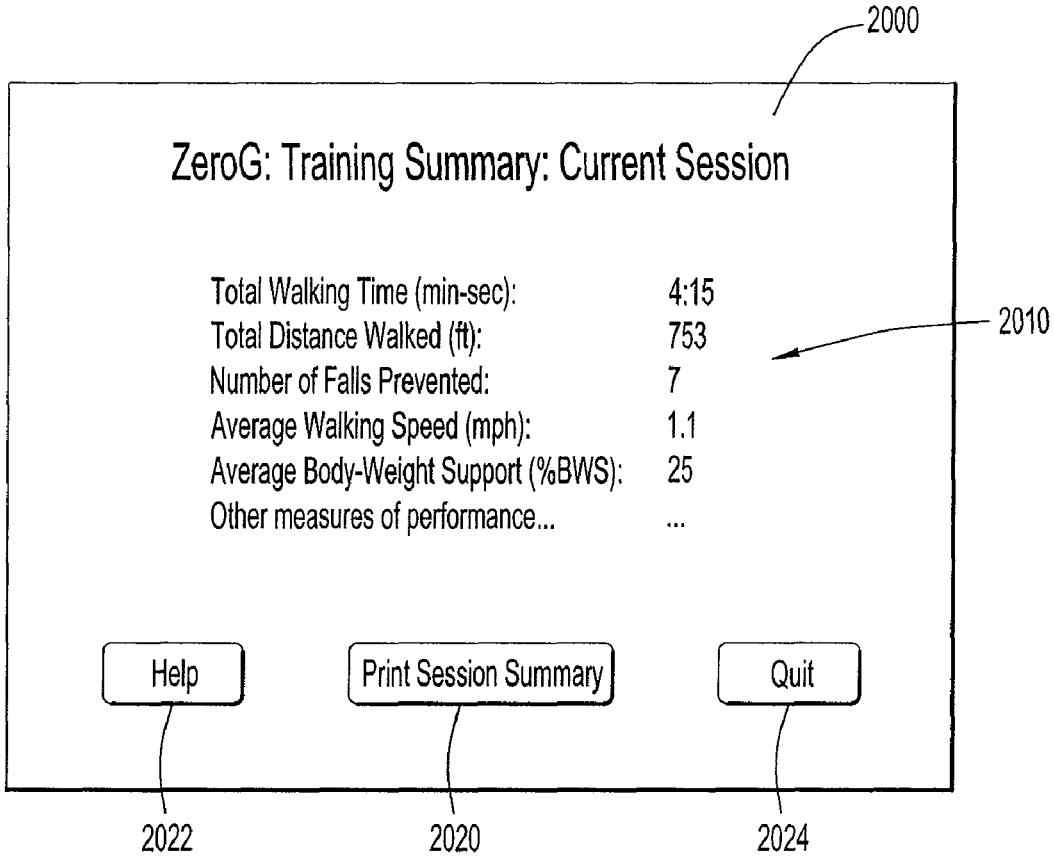

Referring to FIG. 36, an interface 2000 relating to a training summary based on a current session is illustrated. Interface 2000 is an exemplary interface that may be used with the system when a user selects the "Current Session" button 1910 in interface 1900 as described above relative to FIG. 35. In other embodiments, interface 2000 can be reached upon the selection of a different button or input mechanism or the natural progression of the program upon the completion of a training session.

Interface 2000 includes a data section 2010 that identifies various parameters or measurements of the training session. In this data section 2010, data or results relating to total walking time, total distance walked, number of falls prevented, average walking speed, and average body-weight support are displayed. In other embodiments, other types and units of data may be tracked by the system and displayed in data section 2010. Interface 2000 includes a "Print Session Summary" button 2020 that can be selected to print the data associated with the current training session. Interface 2000 also includes a "Help" button 2022 and a "Quit" button 2024.

Figure 37:
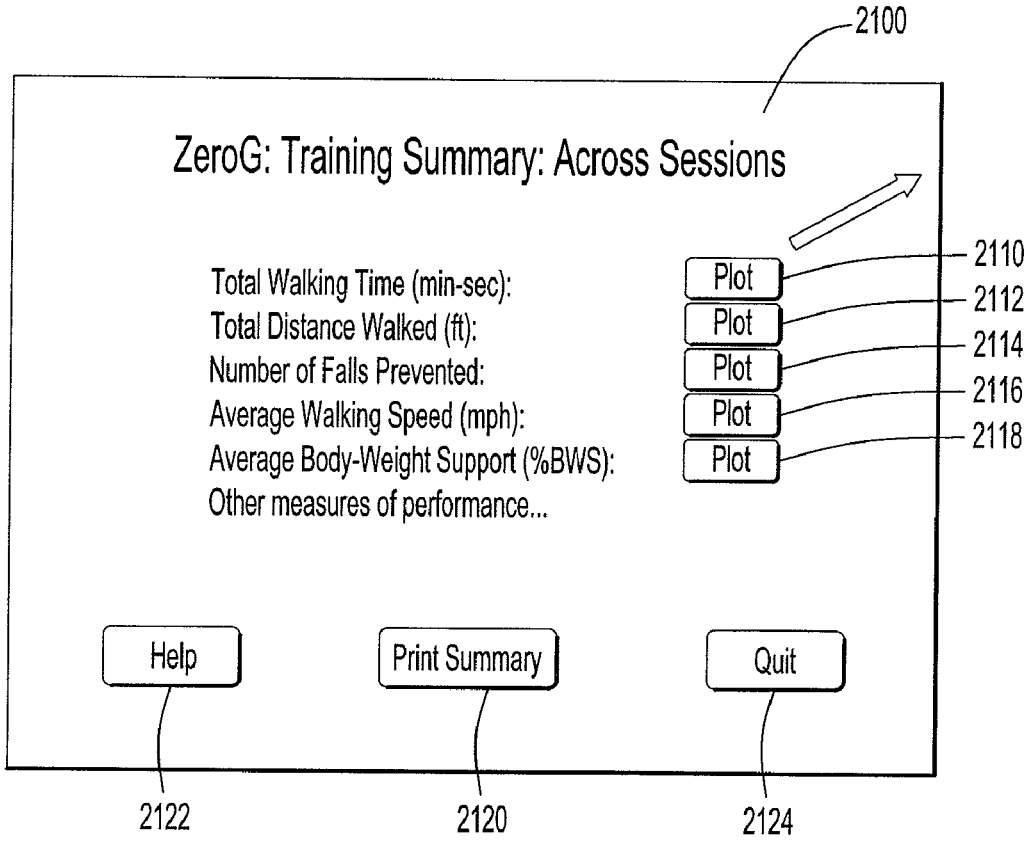

Referring to FIG. 37, an interface 2100 relating to a training summary based on multiple training sessions is illustrated. Interface 2100 is an exemplary interface that may be used with the system when a user selects the "Across Sessions" button 1912 in interface 1900 as described above relative to FIG. 35. In other embodiments, interface 2100 can be reached upon the selection of a different button or input mechanism or the natural progression of the program upon the completion of a training session.

Interface 2100 includes a section that identifies the various parameters or measurements of the training sessions that can be processed and output to the user. In this embodiment, data or results relating to total walking time, total distance walked, number of falls prevented, average walking speed, and average body-weight support can be selected and subsequently displayed. In other embodiments, other types and units of data may be tracked by the system and displayed.

Interface 2100 includes several "Plot" buttons 2110, 2112, 2114, 2116, and 2118, each of which is associated with a particular parameter or data measurement for the training sessions. Depending on the particular "Plot" button selected by the user, a different output is generated and displayed. Interface 2100 includes a "Print Summary" button 2120 that can be selected to print the summary associated with the training sessions. Interface 2100 also includes a "Help" button 2122 and a "Quit" button 2124.

Figure 38:
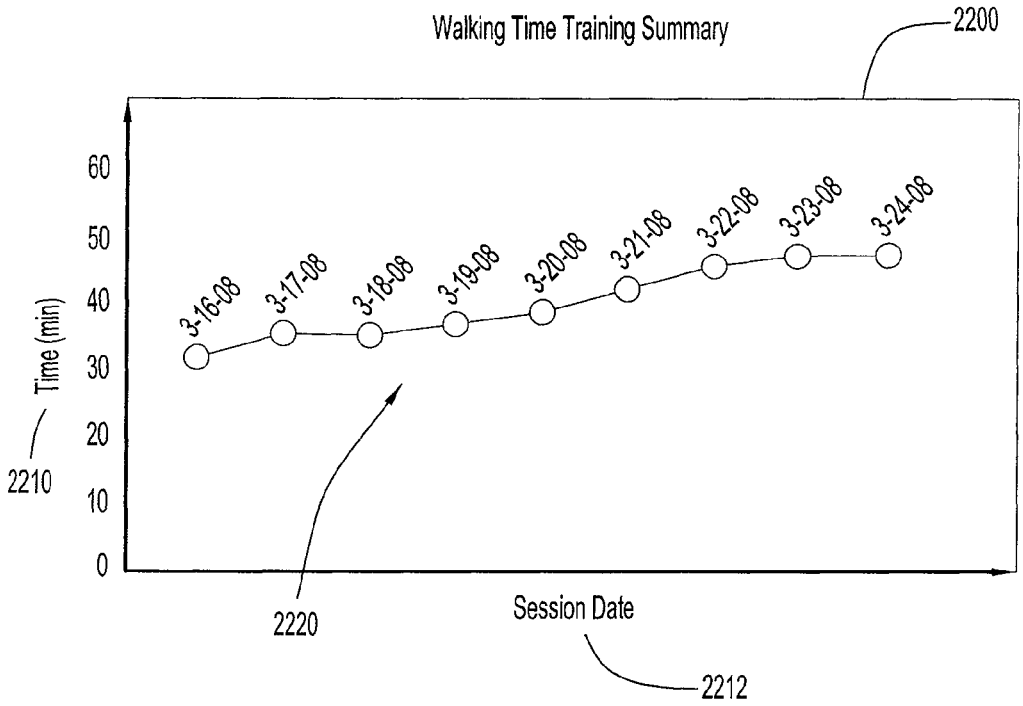

Referring to FIG. 38, an interface 2200 showing a plotted training summary across sessions is illustrated. Interface 2200 is an exemplary interface that may be used with the system when a user selects the "Plot" button 2110 in interface 2100 as described above relative to FIG. 37. If any of the other "Plot" buttons 2112, 2114, 2116, or 2118 is selected, a similar training summary plot can be generated with the appropriate units.

Interface 2200 includes the measured data 2210 along one axis and the session date along another axis 2212. In other embodiments, the session date can be replaced with other units of time, such as session time. Referring to FIG. 38, a line output 2220 is generated based on the time data on particular dates. The graph may include a title indicating the particular training session data, which in this example is "Walking Time Training Summary."

Figure 39:
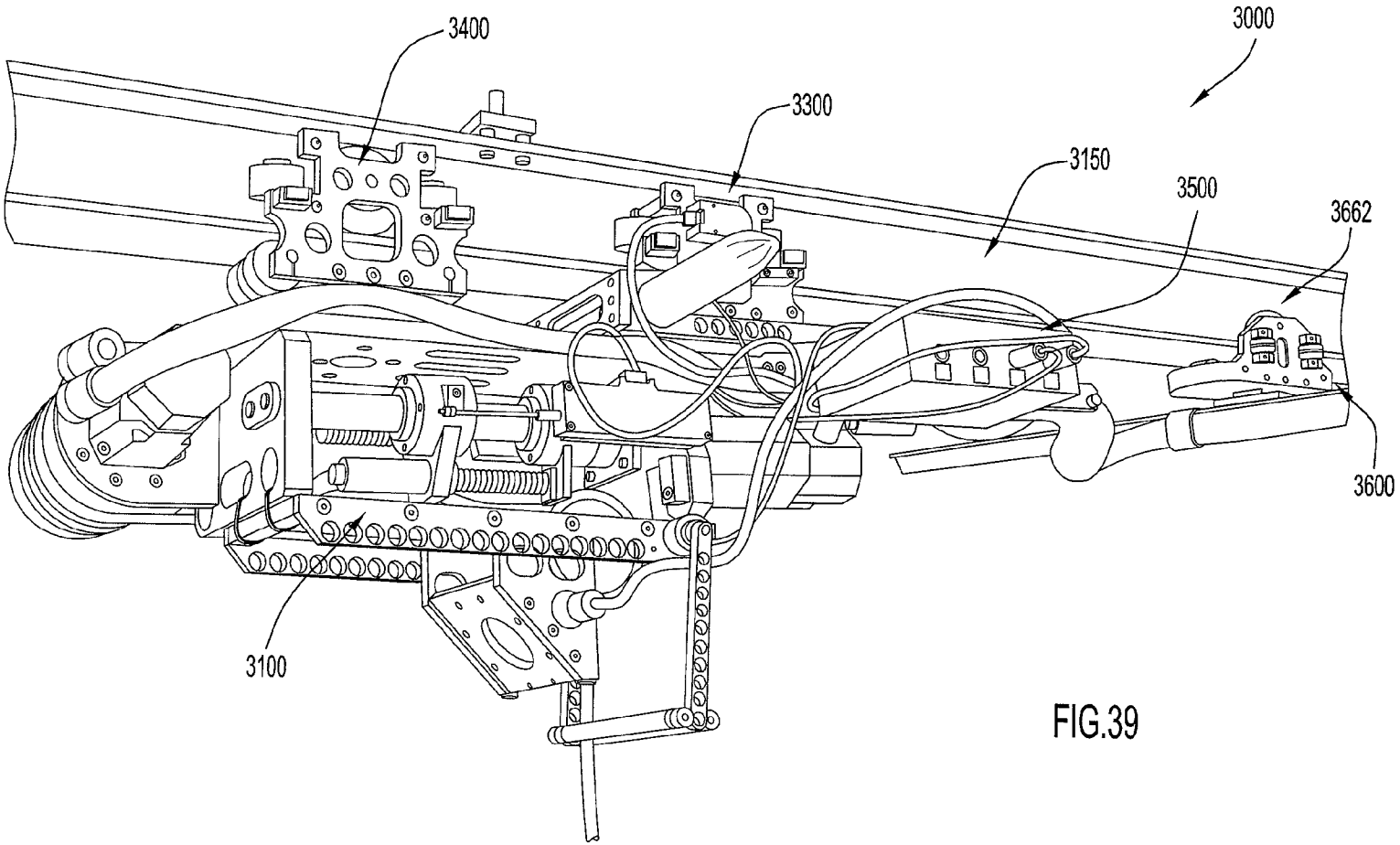
FIG. 39 is a perspective view of an alternative embodiment of a body-weight support system according to the present invention.
Figure 45:
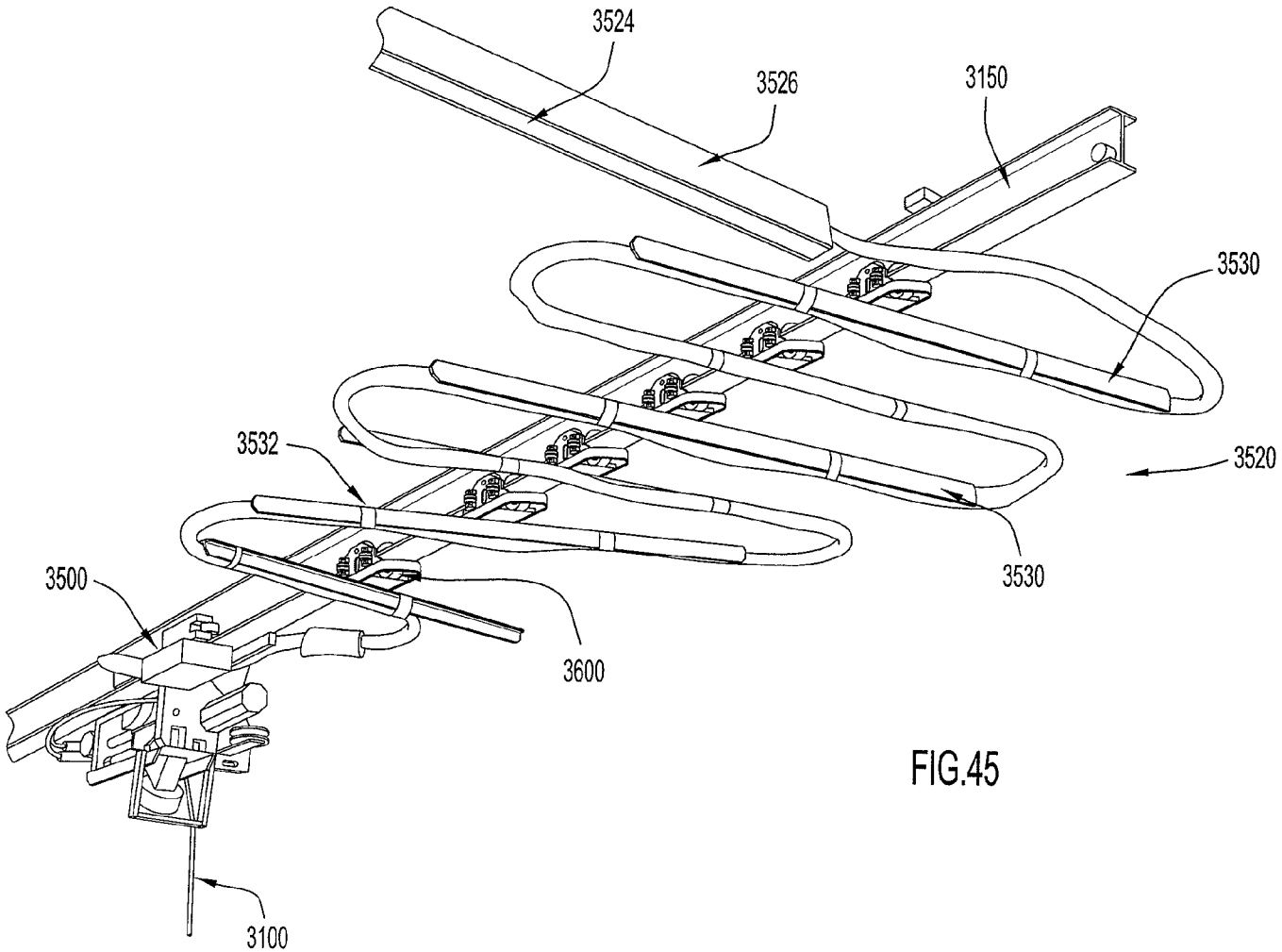
FIG. 45 is a perspective view of the body-weight support system illustrated in FIG. 39 mounted on a track.
Figure 46:
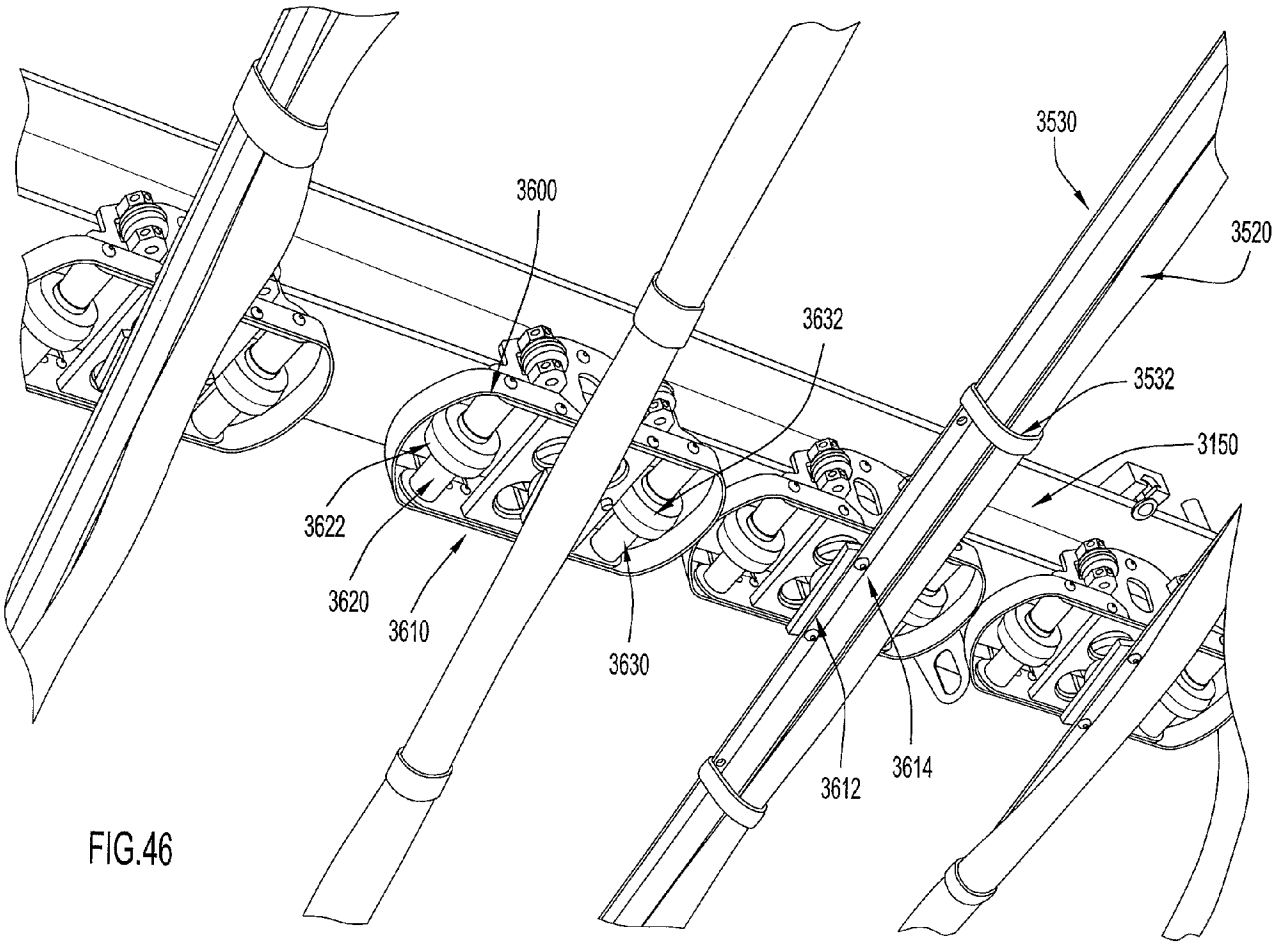
FIG. 46 is a close-up bottom view of the cables and festoons of the body-weight support system illustrated in FIG. 45.

An alternative embodiment of a body-weight support system is illustrated in FIGS. 39-46. In this embodiment, the body-weight support system 3000 includes a trolley 3100 that is movably mounted to a track 3150 as shown in FIG. 39. Rotatably coupled to the trolley 3100 are pivoting wheel assemblies 3400 and 3300, each of which is described in detail below. Also mounted to the trolley 3100 is an electrical housing 3500 to which various cables, wires or other communication links 3520 are connected. As shown in FIGS. 45 and 46, the cables or wires 3520 are coupled to multiple festoons 3600 that are slidably mounted to the track 3150 and movable by way of wheels 3662.

Figure 40:
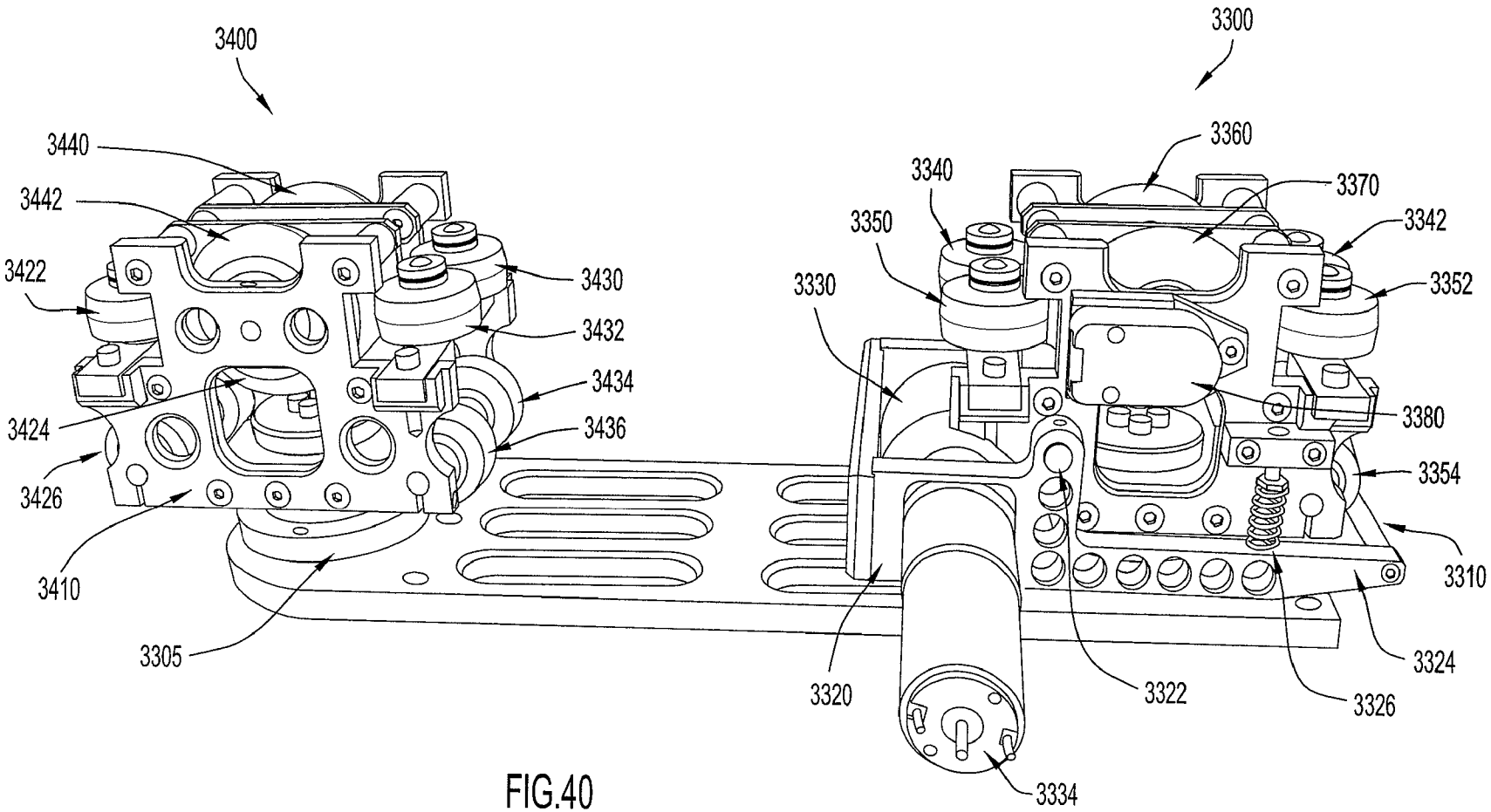
FIG. 40 is a perspective view of some of the components of the body-weight support system illustrated in FIG. 39.

Referring to FIG. 40, a bottom perspective view of some of the components of the trolley 3100 are illustrated. In this embodiment, the trolley 3100 includes a base 3305 to which pivoting wheel assemblies 3400 and 3300 are rotatably mounted on bearings 3306 (see FIG. 44). Pivoting wheel assembly 3400 is a passive assembly that includes a housing 3410 and several wheels mounted to the housing 3410 that contact different surfaces of the track 3150.

Figure 42:
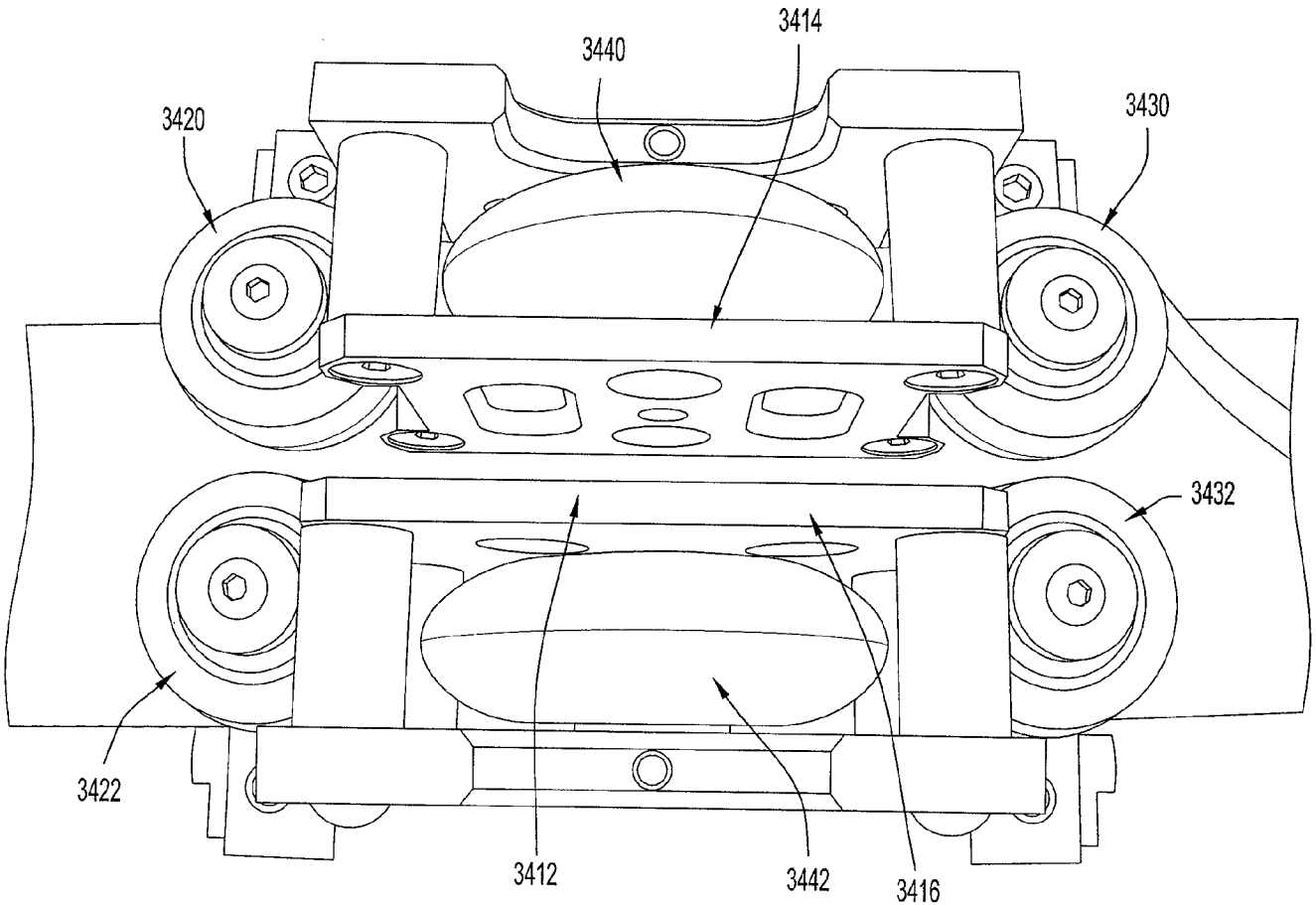
FIG. 42 is a close-up view of some of the wheels and associated mounting structures of the body-weight support system illustrated in FIG. 39.
Figure 43:
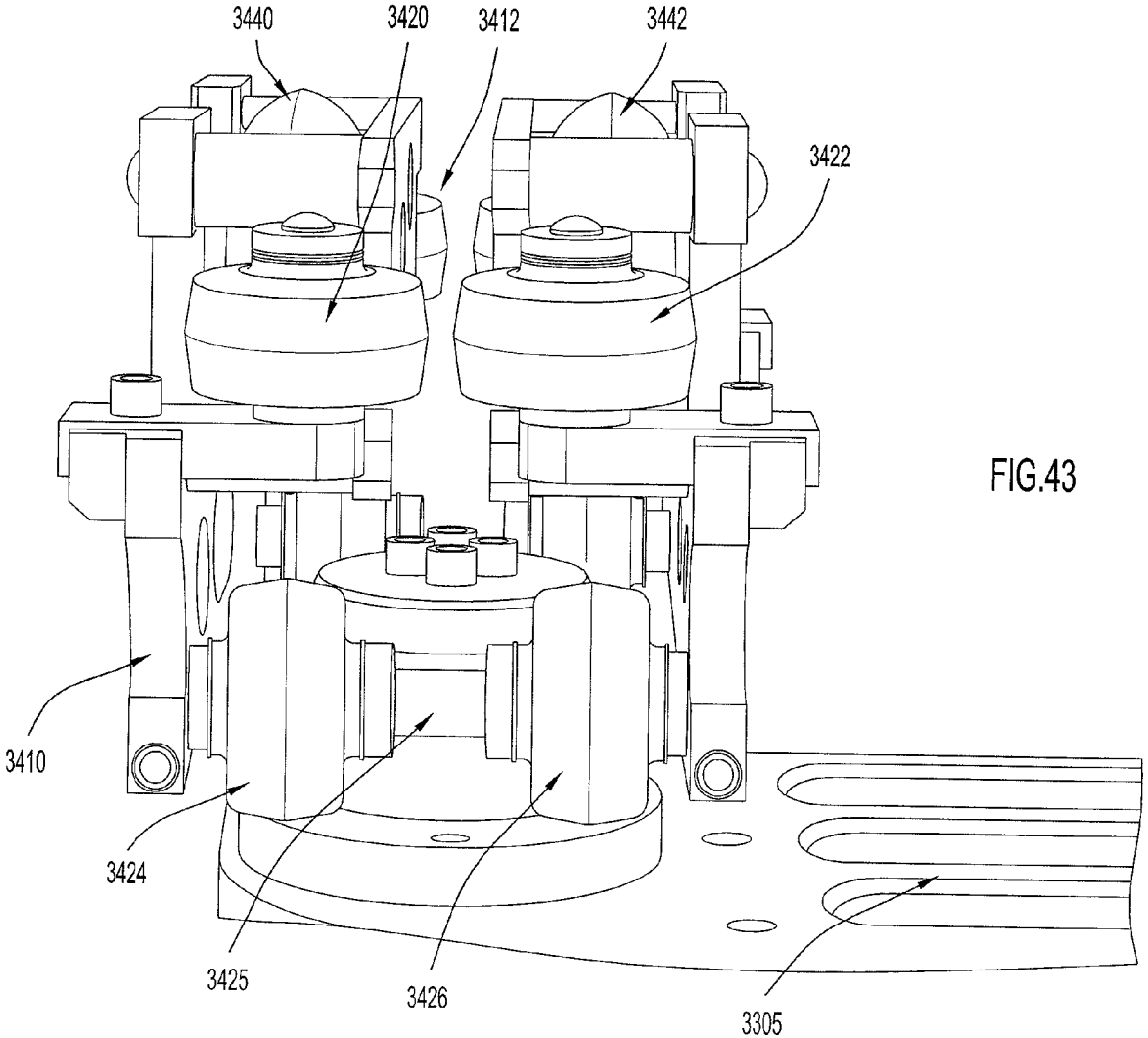
FIG. 43 is an end view of the wheels and associated mounting structures illustrated in FIG. 42.
Figure 44:
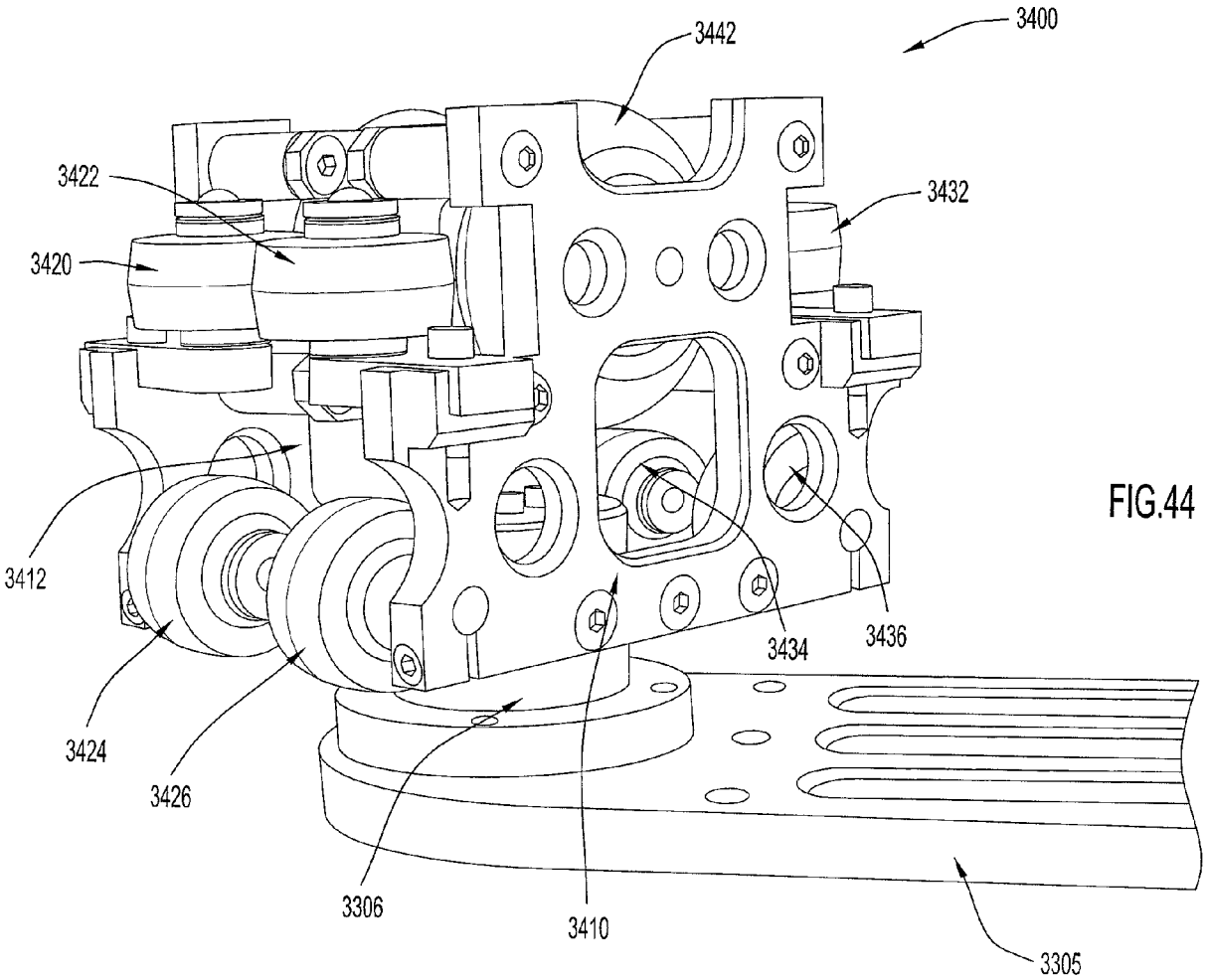
FIG. 44 is a perspective view of a trolley wheel assembly of the body-weight support system illustrated in FIG. 39.

Referring to FIGS. 40 and 42-44, pivoting wheel assembly 3400 includes wheels 3440 and 3442 that rest on the upper inner surface of the lower flange of the track 3150 (such as on top of flange 46C). Pivoting wheel assembly 3400 also includes wheels 3430 and 3432 and wheels 3420 and 3422 that roll on the web of the I-beam track to provide lateral stability. Pivoting wheel assembly 3400 also includes wheels 3424 and 3426 and wheels 3434 and 3436 that are configured to roll on the bottom of the lower flange of the I-beam to provide stability in the vertical direction. As shown in FIG. 43, wheels 3424 and 3426 are rotatably mounted on an axle 3425.

Referring to FIGS. 42 and 43, the housing 3410 includes two housing portions 3414 and 3416 that define therebetween a channel 3412. The channel 3412 is configured to slidably receive the web or middle portion of the I-beam track 3150 (such as track portion 46B described above).

Figure 41:
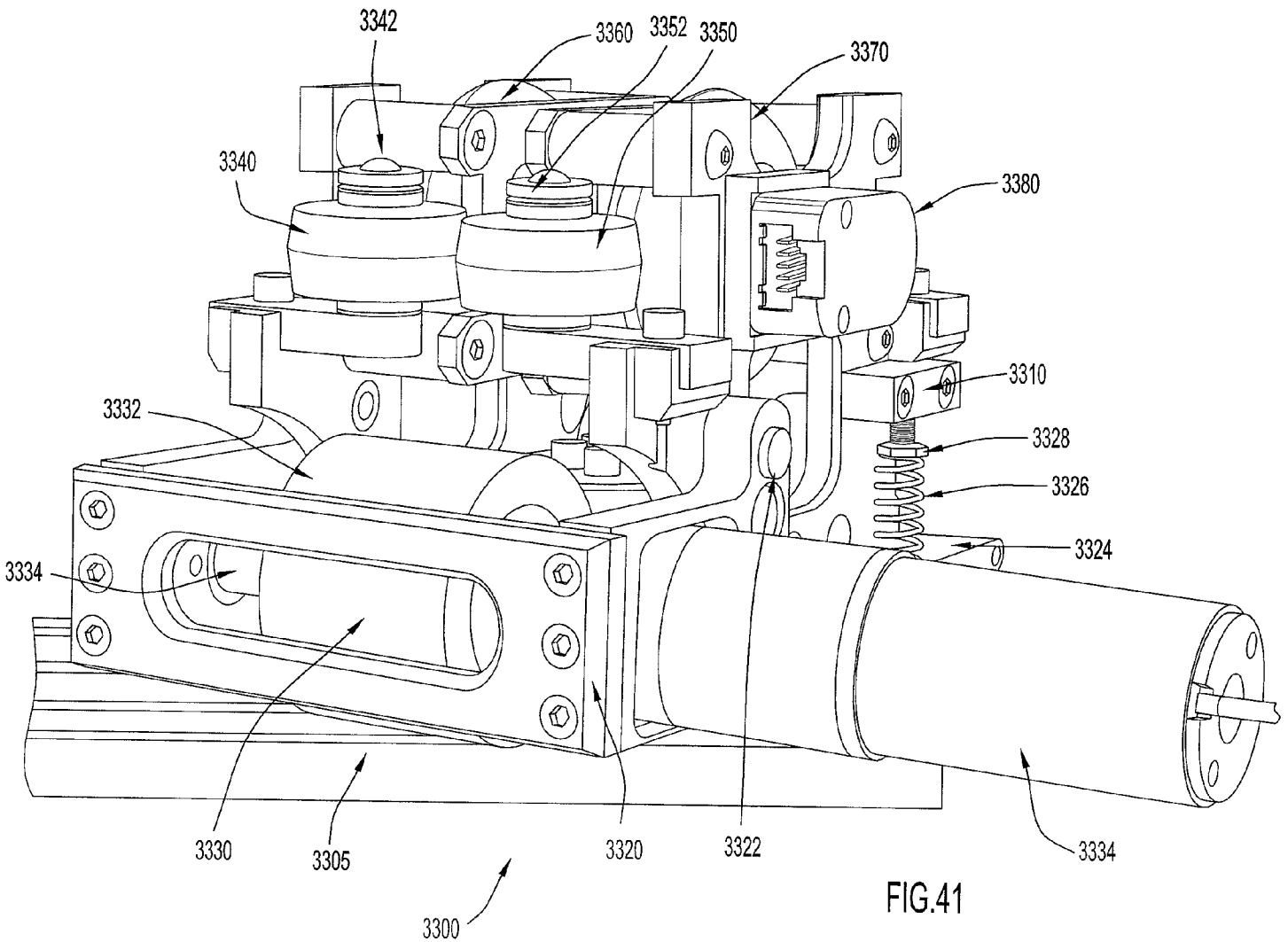
FIG. 41 is a close-up view of some of the components of the body-weight support system illustrated in FIG. 39.

Referring to FIGS. 40 and 41, pivoting wheel assembly 3300 is illustrated. Pivoting wheel assembly 3300 is rotatably mounted to the base 3305 of the trolley 3100 by a bearing. Pivoting wheel assembly 3300 is different from pivoting wheel assembly 3400 in that assembly 3300 includes a trolley motor 3334 that is coupled to a drive wheel 3330 that engages the track 3150 to move the trolley 3100 along the track 3150. As shown in FIG. 41, the drive wheel 3330 includes an outer surface 3332 and is rotatably mounted on an axle 3334. The drive wheel 3330 is mounted in a drive wheel body 3320 that is pivotally mounted to the housing 3310 by an axle 3322. On each side of the drive wheel body 3320 there is a spring 3326 that engages an upper end or limit 3328 (see FIG. 41) and exerts a downward force on end or portion 3324 of the drive wheel body 3320 so that the drive wheel 3330 is forced into contact with the track 3150.

Referring to FIGS. 40 and 41, pairs of upper wheels 3340 and 3350 and upper wheels 3342 and 3352 and lower wheels (only 3354 is visible) are used in combination with support wheels 3360 and 3370 to engage various surfaces of the I-beam track and provide vertical and lateral support for the pivoting wheel assembly 3300 and the trolley 3100. An encoder 3380 is mounted on the axle that supports wheels 3360 and 3370. The encoder 3380 is configured to measure the distance walked by the subject, the speed of walking, and other data.

Referring to FIGS. 45 and 46, an embodiment of a cable support system is illustrated. As shown, the trolley 3100 is movably mounted on the track 3150. The trolley 3100 includes an electrical housing 3500 to which cables, wires, and/or other communication links 3520 can be coupled. The cables 3520 are bundled together and coupled to support arms 3530 using a fastener 3532 such as a combination of a hook-type material and a loop-type material. Fasteners 3532 are used to secure the cables 3520 to the support arms 3530.

Each support arm 3530 is pivotally coupled to a festoon 3600 that is slidably mounted on the track 3150. As the trolley 3100 moves in a direction along the track 3150, the trolley 3100 pulls on the cables 3520 in the same direction. Initially, the festoon 3600 closest to the trolley 3100 begins to move and as the trolley 3100 continues to move, the next festoon 3600 begins to move. Continued movement of the trolley 3100 causes additional festoons 3600 to move. Movement of the trolley 3100 in the opposite direction causes the festoons to move in that opposite direction as well. The support arms 3530 provide support stiffness to the cables 3520. In addition, the support arms 3530 maintain the cables 3520 in a substantially horizontal plane which prevents the cables 3520 from becoming tangled and in the way of the patient. At the end of the festooning system, the cables 3520 pass through a support member 3524 that defines a channel 3526.

Referring to FIG. 46, the festoons and cable mounting structure are illustrated in greater detail. Each festoon 3600 includes a body 3610 with an axle 3620 on which a wheel 3622 is mounted and an axle 3630 on which a wheel 3632 is mounted. Wheels 3622 and 3632 are disposed so that they engage the lower surface of the I-beam track 3150. An upper wheel 3662 is located on each side of the I-beam track 3150.

Support arm 3530 can be coupled to a rotatably mounted plate 3612 using fasteners 3614. The rotatably mounting of the support arm 3530 facilitates the rotation of the support arm 3530 as the corresponding festoon 3600 moves.

In various embodiments of the invention, any combination of components can be used as part of or with the trolley. In addition, any combination of sensors or detectors can be used with the controller to determine the appropriate feedback and inputs to control the movement of the trolley.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention.

What is claimed is:

1. A body-weight support system for use with a person, comprising:

a track;

a support, the support being supported on the track, the support being movable in a first direction and in a second direction opposite to the first direction, the support including a drive mechanism to move the support along the track;

an elongate member, the elongate member including a first end and a second end, the first end of the elongate member being coupled to the support;

a harness assembly, the harness assembly being coupled to the second end of the elongate member and configured to be mounted to the person;

a control system, the control system being configured to detect at least one of the movement of the person relative to the support, the movement of the support along the track, and a change in the amount of force applied to the elongate member; and an adjustment system, the adjustment system being connected to the control system and engaged by the elongate member, the adjustment system being configured to vary at least one of the position of the support and the amount of force applied to the elongate member based on information detected by the control system, the adjustment system including a first plate and a second plate spaced apart from the first plate, the second plate being freely movable relative to the first plate during operation of the system, the control system including a series elastic actuator that is used to control tension in the elongate member, the adjustment system also including a pulley coupled to the second plate and located in an area defined between the first plate and the second plate, wherein the series elastic actuator includes an elastic member and a detector, the detector is configured to detect a change in length of the elastic member, the amount of force applied to the elongate member can be varied based on the detected change in length of the elastic member, the elastic member being located between the first plate and the second plate and compressed when an additional force is applied to the elongate member, the elongate member being engaged with the pulley and moving the second plate toward the first plate when the additional force is applied, and the elongate member is a rope.

2. The body-weight support system of claim 1, wherein movement of the support is determined based on the movement of the person.

3. The body-weight support system of claim 2, wherein the support is continuously moved so that the support is one of above or slightly in front of the person as the person moves.

* * * * *